US010578389B2

(12) United States Patent
Kinney et al.

(10) Patent No.: US 10,578,389 B2
(45) Date of Patent: Mar. 3, 2020

(54) PORTABLE SHOOTING BENCH

(71) Applicant: Battenfeld Technologies, Inc., Columbia, MO (US)

(72) Inventors: Timothy Kinney, Warrenton, MO (US); James Tayon, Moberly, MO (US); Michael Cottrell, Ashland, MO (US); Dennis W. Cauley, Jr., Fayette, MO (US); Justin Burke, Columbia, MO (US); Anthony Vesich, Columbia, MO (US); Michael Poehlman, Columbia, MO (US); James Gianladis, Harrisburg, MO (US); Matthew Kinamore, Columbia, MO (US); Joel Yuodsnukis, Columbia, MO (US); Mark Dalton, Columbia, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 0 days.

(21) Appl. No.: 15/912,762

(22) Filed: Mar. 6, 2018

(65) Prior Publication Data

US 2019/0277594 A1 Sep. 12, 2019

(51) Int. Cl.
*F41A 23/16* (2006.01)
*A47B 3/14* (2006.01)

(52) U.S. Cl.
CPC ..... *F41A 23/16* (2013.01); *A47B 3/14* (2013.01); *A47B 2200/0035* (2013.01)

(58) Field of Classification Search
CPC . F41A 23/16; F41A 23/00; A47B 3/14; A47B 2200/0035
USPC ..... 42/94
See application file for complete search history.

(56) References Cited

U.S. PATENT DOCUMENTS

| | | | | |
|---|---|---|---|---|
| 1,187,325 | A | 6/1916 | Ivey | |
| 1,639,722 | A | 8/1927 | Clark | |
| 1,938,345 | A * | 12/1933 | Monchiero | A47B 3/14 248/240.2 |
| 2,079,510 | A | 5/1937 | King et al. | |
| 2,572,585 | A * | 10/1951 | Barber | A47B 3/14 108/99 |
| 2,821,117 | A | 1/1958 | Hultgren | |
| 2,973,803 | A * | 3/1961 | Mickelson | A47B 3/14 297/170 |
| 3,125,929 | A | 3/1964 | Peasley | |
| 3,225,656 | A | 12/1965 | Flaherty et al. | |
| 3,349,728 | A * | 10/1967 | Barecki | A47B 3/0912 108/115 |

(Continued)

OTHER PUBLICATIONS

Caldwell Shooting Supplies, Assembly and Usage Instructions for the Stable Table Shooting Bench, Instruction #1000196, Revision E, Jan. 1, 2017, 4 pages.

(Continued)

*Primary Examiner* — Joshua E Freeman
(74) *Attorney, Agent, or Firm* — Stinson LLP

(57) ABSTRACT

A portable shooting bench configurable in a stowed configuration and a deployed configuration. In the deployed configuration, the shooting bench can be adjusted to accommodate a right-handed shooter or a left-handed shooter. Other adjustment capability is provided. The shooting bench is relatively lightweight. In the stowed configuration, the shooting bench is relatively compact to facilitate transportation and storage.

26 Claims, 21 Drawing Sheets

(56) References Cited

U.S. PATENT DOCUMENTS 3,474,743 A * 10/1969 Blevins ..... D05B 75/02 108/129
3,711,984 A 1/1973 Dyer et al.
4,266,748 A 5/1981 Dalton
4,296,963 A * 10/1981 Blanchard ..... F41A 23/00 108/100
4,506,466 A 3/1985 Hall
4,535,559 A * 8/1985 Hall ..... F41A 23/00 42/94
4,545,144 A * 10/1985 Schuster ..... F41A 23/00 108/27
4,565,403 A 1/1986 Brown
4,798,411 A 1/1989 Lin
5,060,410 A 10/1991 Mueller
5,149,900 A 9/1992 Buck
5,173,563 A 12/1992 Gray
5,271,175 A 12/1993 West, III
5,287,643 A 2/1994 Arizpe-Gilmore
5,347,740 A 9/1994 Rather et al.
5,414,949 A 5/1995 Peebles
5,421,115 A 6/1995 McKay
5,481,817 A 1/1996 Parker
5,491,921 A 2/1996 Allen
D377,823 S * 2/1997 Rainwater ..... D22/108
5,697,180 A * 12/1997 Morizio ..... F41A 23/02 42/94
5,715,625 A 2/1998 West, III
5,833,308 A 11/1998 Strong, III et al.
5,884,966 A 3/1999 Hill et al.
6,058,641 A 5/2000 Vecqueray
6,347,831 B1 * 2/2002 Nye ..... A47B 3/14 297/118
6,895,709 B1 * 5/2005 Krien ..... A47B 83/02 42/94
7,032,965 B2 * 4/2006 Howell ..... A01M 31/02 297/16.1
7,059,670 B2 * 6/2006 Mills ..... A47B 7/02 297/160
7,152,358 B1 12/2006 LeAnna et al.
7,281,347 B2 * 10/2007 Carpenter ..... F41A 23/14 248/416
7,314,248 B2 * 1/2008 Mabon ..... A47B 9/08 297/118
7,549,247 B1 6/2009 Reese
D709,295 S * 7/2014 Winebrenner ..... D6/338
9,341,427 B2 * 5/2016 Bricko ..... F41A 23/16
9,743,774 B1 * 8/2017 Hauser ..... A47C 9/10
2008/0018142 A1 * 1/2008 Yul ..... A47B 3/14 297/158.4
2008/0238158 A1 * 10/2008 Jiu ..... A47B 3/14 297/158.4
2009/0049731 A1 * 2/2009 Seuk ..... F41A 23/16 42/94
2009/0113779 A1 * 5/2009 Shipman ..... F16M 11/10 42/94
2009/0140557 A1 * 6/2009 Chen ..... A47B 3/14 297/142
2013/0061508 A1 * 3/2013 Nelson ..... F41A 23/16 42/94
2015/0096216 A1 * 4/2015 Hughes ..... F41A 23/12 42/94
2016/0003571 A1 * 1/2016 Kleinfelder ..... F41A 23/56 42/94
2017/0251803 A1 * 9/2017 Rehkemper ..... A47B 13/02
2017/0273451 A1 * 9/2017 Jeanphilippe ..... A47B 3/14
2017/0340100 A1 * 11/2017 Tsai ..... A47B 3/14
2018/0172385 A1 * 6/2018 Hale ..... F41A 23/16

OTHER PUBLICATIONS

Caldwell Shooting Supplies, Assembly and Usage Instructions, BR Pivot Shooting Bench, Instruction #1001667, Jan. 1, 2017, 6 pages.
Herter's Deluxe Shooting Bench: Cabela's, 2 pages, accessed Jan. 8, 2018, <https://www.cabelas.com/product/HERTERS-SHOOTING-BENCH/2201557.uts?slotId=0>.
MSB200—Muddy Deluxe Shooting Bench, 4 pages, accessed Jan. 8, 2018.
Muddy, The Swivel Action Shooting Bench, 4 pages, accessed Jan. 8, 2018, <https://shop.gomuddy.com/the-swivel-action-shooting-bench/>.
Muddy, The Xtreme Shooting Bench, 4 pages, accessed Jan. 8, 2018.

* cited by examiner

PORTABLE SHOOTING BENCH

FIELD

The present disclosure generally relates to firearm shooting accessories, and more particularly to a portable shooting bench.

BACKGROUND

Shooting benches or bench rests are used to support and stabilize a shooter firing a firearm and usually also to support and stabilize the firearm being fired. Some shooting benches are designed to be portable. However, many portable shooting benches are relatively heavy and require assembly for use and disassembly for storage.

SUMMARY

In one aspect, a portable shooting bench for supporting a shooter above a ground surface includes a chair and a table. The chair includes a seat and at least one leg configured to engage the ground surface to support the seat above the ground surface. The seat has a sitting area sized and shaped to be sat on by the shooter. The table includes a table top and at least one leg. The table top includes a forward section and a rearward section. The at least one leg is configured to engage the ground surface to support the forward section of the table top above the ground surface. A support structure connects the chair to the table. The support structure is configured to support the rearward section of the table top above the ground surface. The support structure defines a first pivot axis about which the table is pivotable laterally with respect to the chair to change an orientation of the chair with respect to the table.

In another aspect, a portable shooting bench for supporting a shooter above a ground surface for shooting a firearm includes a seat and a table. The seat has a sitting area sized and shaped to be sat on by the shooter. The sitting area has a front edge, a rear edge, and a length extending therebetween. The table includes a table top and at least two legs. The table top has a front edge and a rear edge and a length extending therebetween. The at least two legs are configured to support the table top above the ground surface. Each leg has a length extending from a proximal end of the leg to a distal end of the leg. A linkage connects the seat and the table. The portable shooting bench is configurable in a deployed configuration for supporting the shooter for shooting the firearm and a stowed configuration for transport and storage. The portable shooting bench is convertible from the deployed configuration to the stowed configuration while the linkage remains connected to the seat and the table. In the deployed configuration, the at least two table legs extend downward away from the table top for engaging the ground surface to support the table top above the ground surface and the seat is positioned for being sat on by the shooter adjacent the rear end of the table top. In the stowed configuration, the seat and table are collapsed together. The seat extends generally parallel to the table top, the at least two legs of the table extend generally parallel to the table top, and no leg of the table extending outboard of the front edge or the rear edge of the table top more than 40 percent of the length of the leg.

In yet another aspect, a portable shooting bench for supporting a shooter above a ground surface for shooting a firearm includes a seat and a table. The seat has a sitting area sized and shaped to be sat on by the shooter. The sitting area has a front edge and a rear edge and a length extending therebetween. The table includes a table top and at least two legs. The table top has a periphery including a front edge and a rear edge. The table top has a length extending between the front and rear edges. The at least two legs are configured to support the table top above the ground surface. Each leg has a length extending from a proximal end of the leg to a distal end of the leg. A linkage connects the seat and table. The portable shooting bench is configurable in a deployed configuration for supporting the shooter for shooting the firearm and a stowed configuration for transport and storage. The portable shooting bench is convertible from the deployed configuration to the stowed configuration while the linkage remains connected to the seat and the table. In the deployed configuration, the linkage connects the seat and the table, the at least two table legs extend downward away from the table top for engaging the ground surface to support the table top above the ground surface, and the seat is positioned for being sat on by the shooter adjacent the rear end of the table top. In the stowed configuration, the linkage connects the seat and the table, the seat and table are collapsed together, the seat extends generally parallel to the table top, the at least two legs of the table extend generally parallel to the table top, at least part of the sitting area is inboard of the periphery of the table top, and the front edge of the sitting area is rearward from the front edge of the table top.

Other objects and features of the present disclosure will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
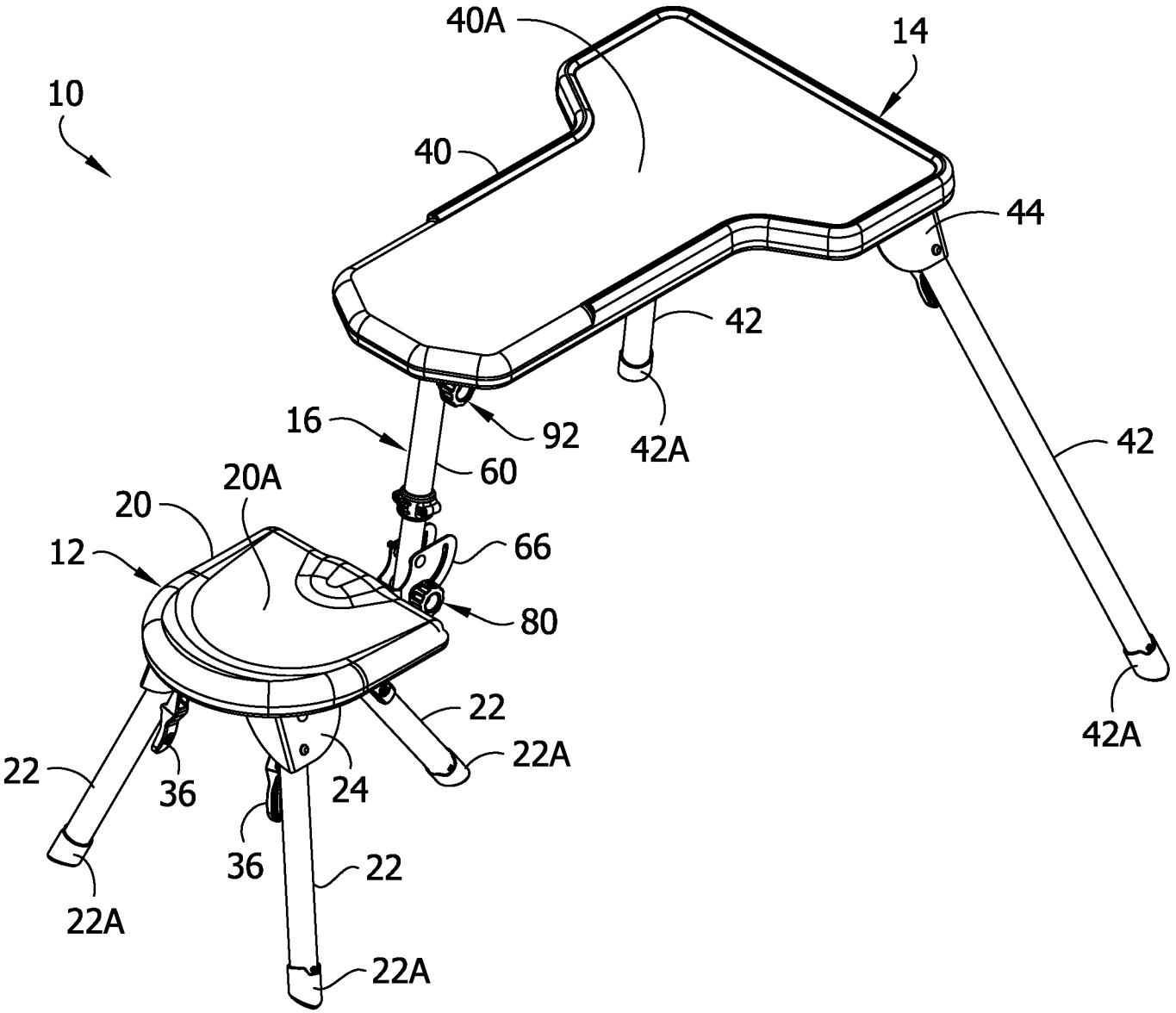
FIG. 1 is a rear perspective of a shooting bench of the present disclosure shown in a deployed, neutral configuration.
Figure 16:
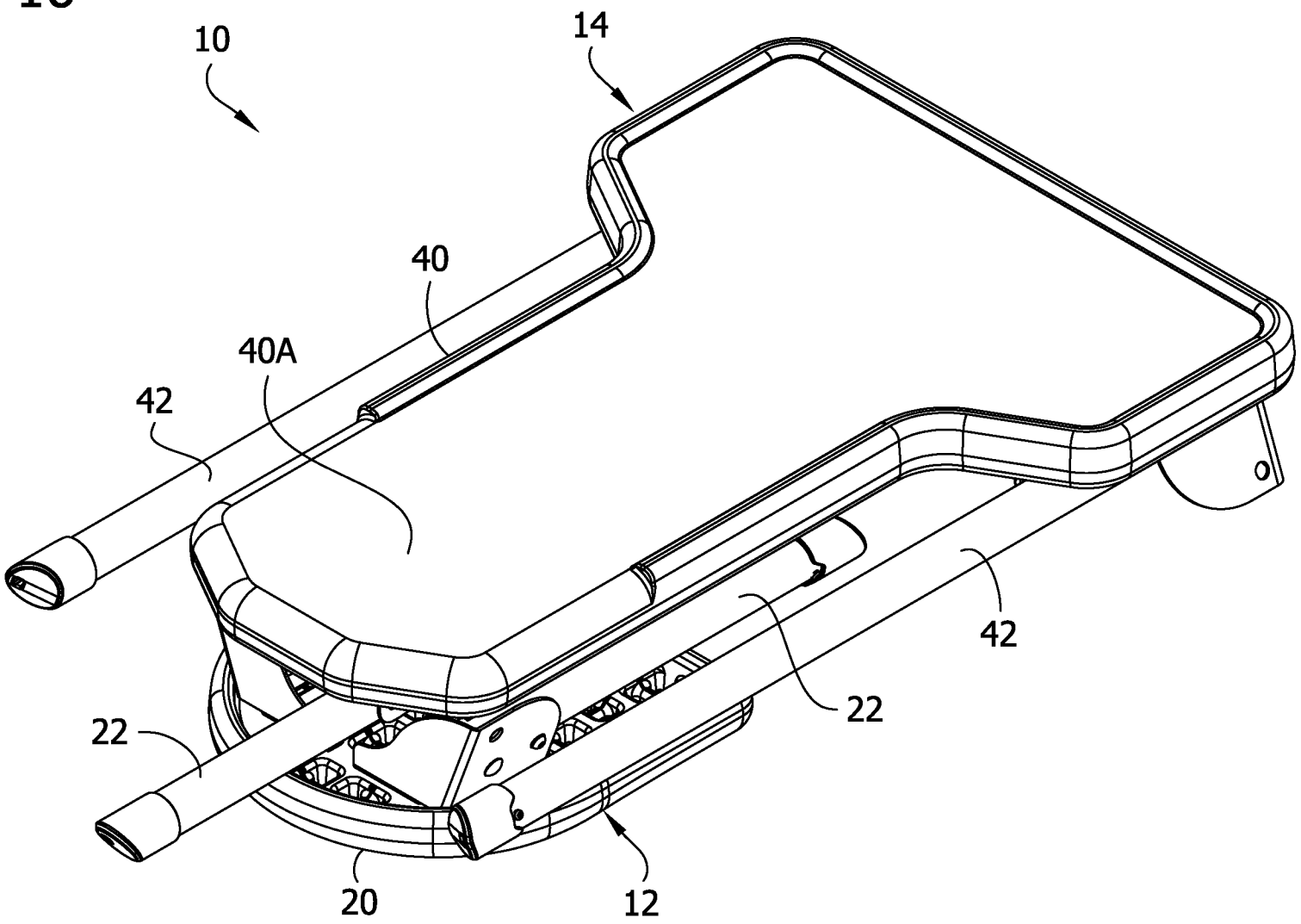
FIG. 16 is a top perspective of the shooting bench in a stowed configuration.

Referring to FIG. 1, a shooting bench of the present disclosure is designated generally by the reference number 10. In general, the shooting bench is designed to support a sitting person (e.g., a shooter) and a firearm to be fired by the person. In the illustrated embodiment, the shooting bench 10 is constructed to be lightweight and portable so that the shooting bench can be conveniently moved to various shooting locations. As will become apparent, the shooting bench 10 is adjustable between a stowed configuration (e.g., FIGS. 16, 17) and a deployed configuration (e.g., FIG. 1). Moreover, in the deployed configuration, the shooting bench 10 is adjustable to adapt for use by left-handed and right-handed shooters. The shooting bench 10 is shown in a neutral arrangement in FIGS. 1-8 and adjusted to a right-handed shooter arrangement in FIGS. 12-15.

The shooting bench 10 generally includes a chair 12, a table 14, and a linkage 16 (broadly "support structure" or "connection structure") connecting the chair and table. The chair 12 is configured to support a person (a shooter) sitting on the chair, and the table 14 is configured to support a firearm to be fired by the person. As will become apparent, the linkage 16 is constructed to support the table 14. The linkage 16 is also constructed to permit arrangement of the shooting bench 10 in the stowed and deployed configurations and to permit the shooting bench to be ambidextrous, i.e., to be used by right-handed and left-handed shooters.

Figure 3:
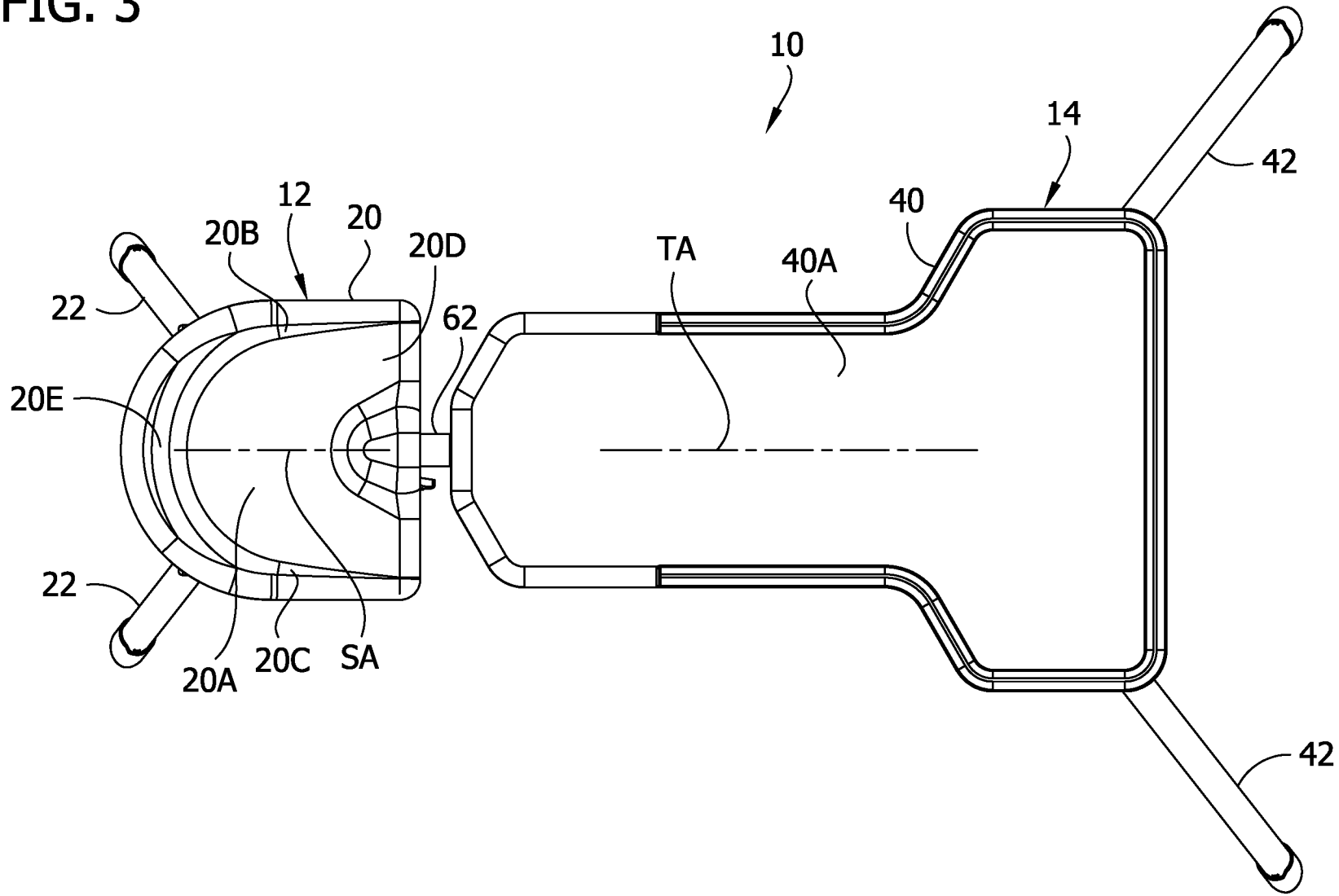
FIG. 3 is a top view of the shooting bench.
Figure 4:
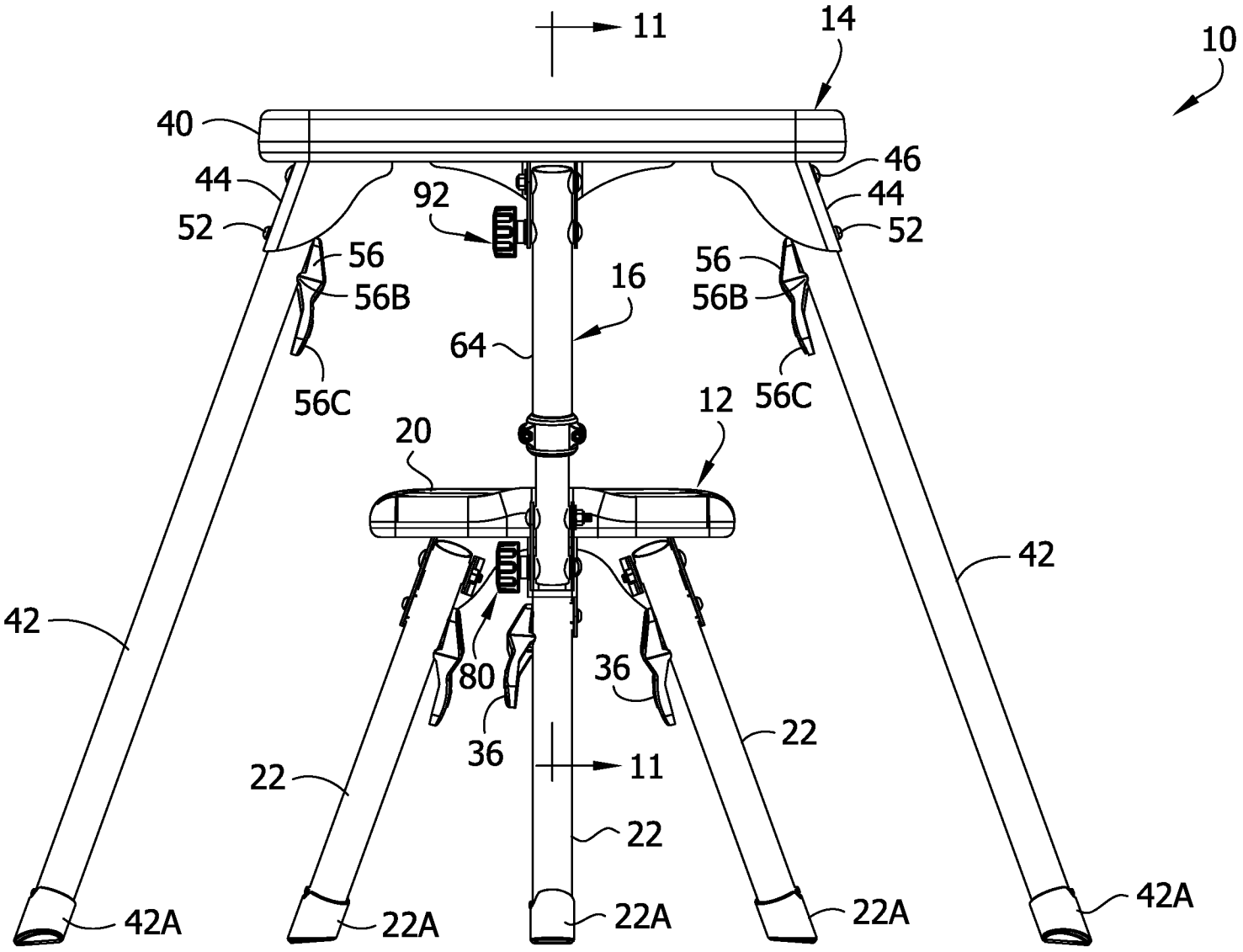
FIG. 4 is a front view of the shooting bench.

As shown in FIGS. 1, 6, 7, and 8, the chair 12 includes a seat 20 and a plurality of legs 22 constructed to engage a ground surface to support the seat above the ground surface. For example, the ground surface can be an exterior surface such as turf, pavement, and/or gravel, etc. or can be an interior surface such as a floor. The seat 20 includes an upper sitting area 20A sized and shaped to be sit on by a person using the shooting bench. For example, the seat 20 can be made of plastic, or another suitable material. As shown in FIG. 3, the sitting area 20A includes a left side 20B, a right side 20C, and front and rear ends 20D, 20E. The seat 20 defines a sitting axis SA between the left and right sides 20B, 20C that extends between the front and rear ends 20D, 20E. When a person is sitting on the seat 20, the sitting axis SA is usually between the person's legs. As explained in further detail below, when the shooting bench 10 is in the neutral arrangement (e.g., FIG. 3), the seat axis SA is generally in alignment with an axis TA of the table 14, and when the shooting bench is adjusted for a right-handed shooter (e.g., FIG. 13) or for a left-handed shooter (not shown), the seat axis is arranged at a skew angle with respect to the table axis.

The chair legs 22 include proximal or upper portions connected to the seat 20 and distal or lower portions having feet 22A for engaging the ground surface. The proximal portions of the legs 22 are pivotally connected to leg brackets 24 that are secured to a bottom of the seat 20. The proximal portions of the legs 22 are connected to outer plates 24A and inner tabs 24B of the brackets 24 by pin connections 28 (e.g., bolts) and are pivotable about the pin connections between stowed positions and deployed positions. In a leg's deployed position, the leg 22 extends from the bracket 24 downward to position the foot 22A for engagement with the ground surface to support the seat 20 above the ground surface. In the illustrated embodiment, three legs 22 are provided, such that the chair 12 is fully self-supporting. The legs 22 and seat 20 form a tripod that fully supports the sitting person and prevents the chair 12 from tipping under normal circumstances. In a leg's stowed position, the leg 22 extends along the bottom of the seat 20 generally parallel with the seat.

Figure 7:
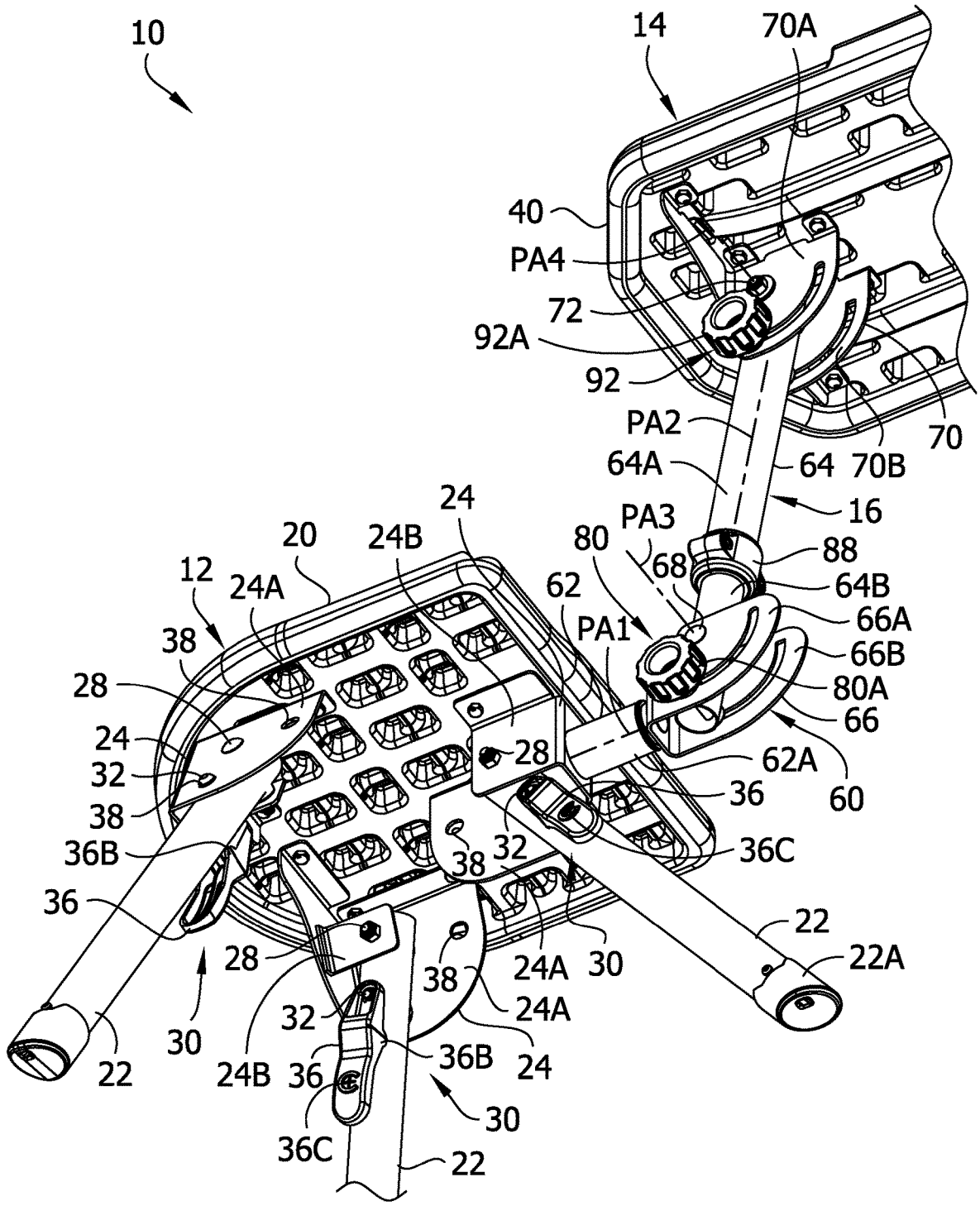
FIG. 7 is an enlarged fragmentary bottom perspective of the shooting bench from a first vantage.
Figure 8:
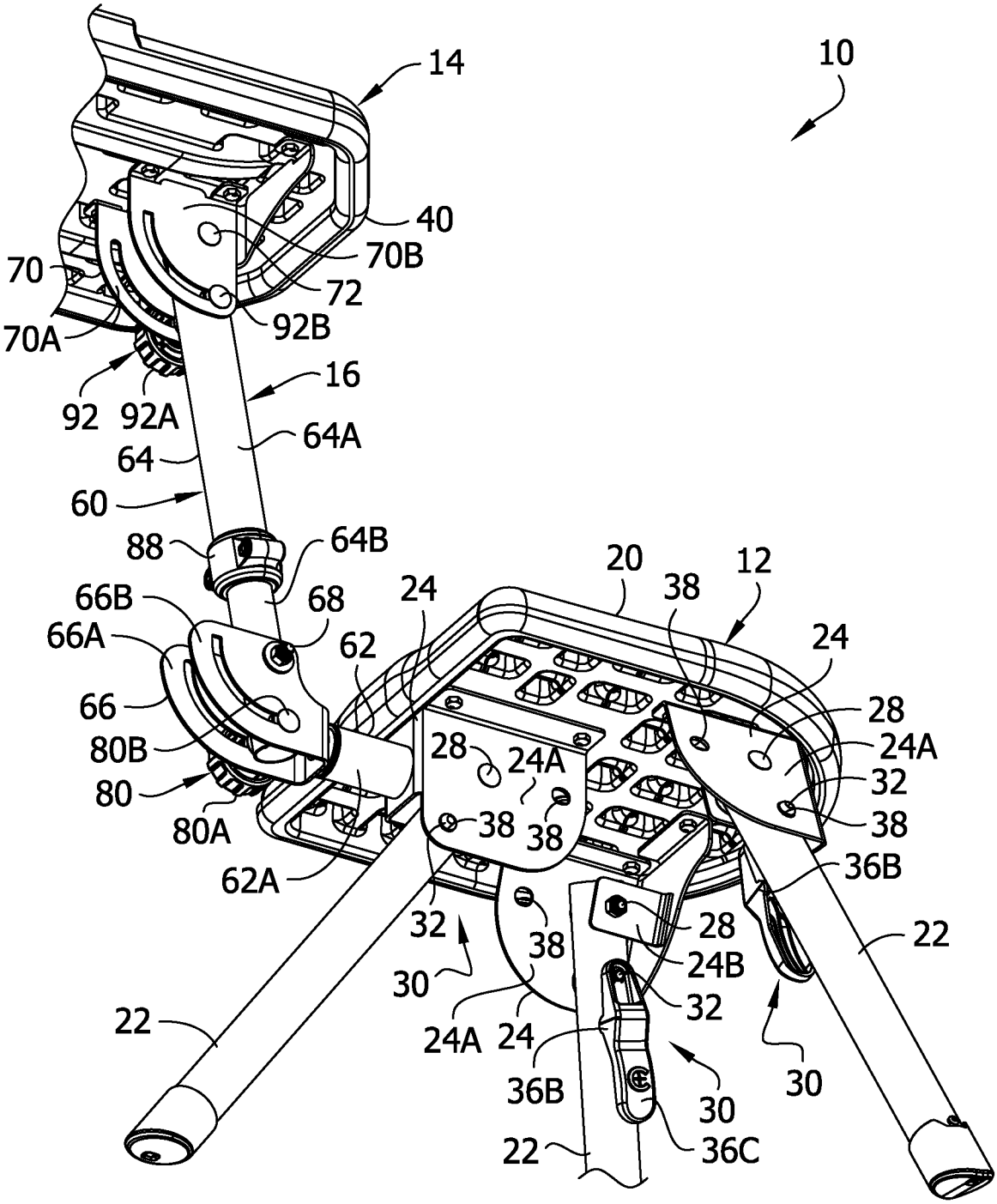
FIG. 8 is an enlarged fragmentary bottom perspective of the shooting bench from a second vantage.
Figure 9:
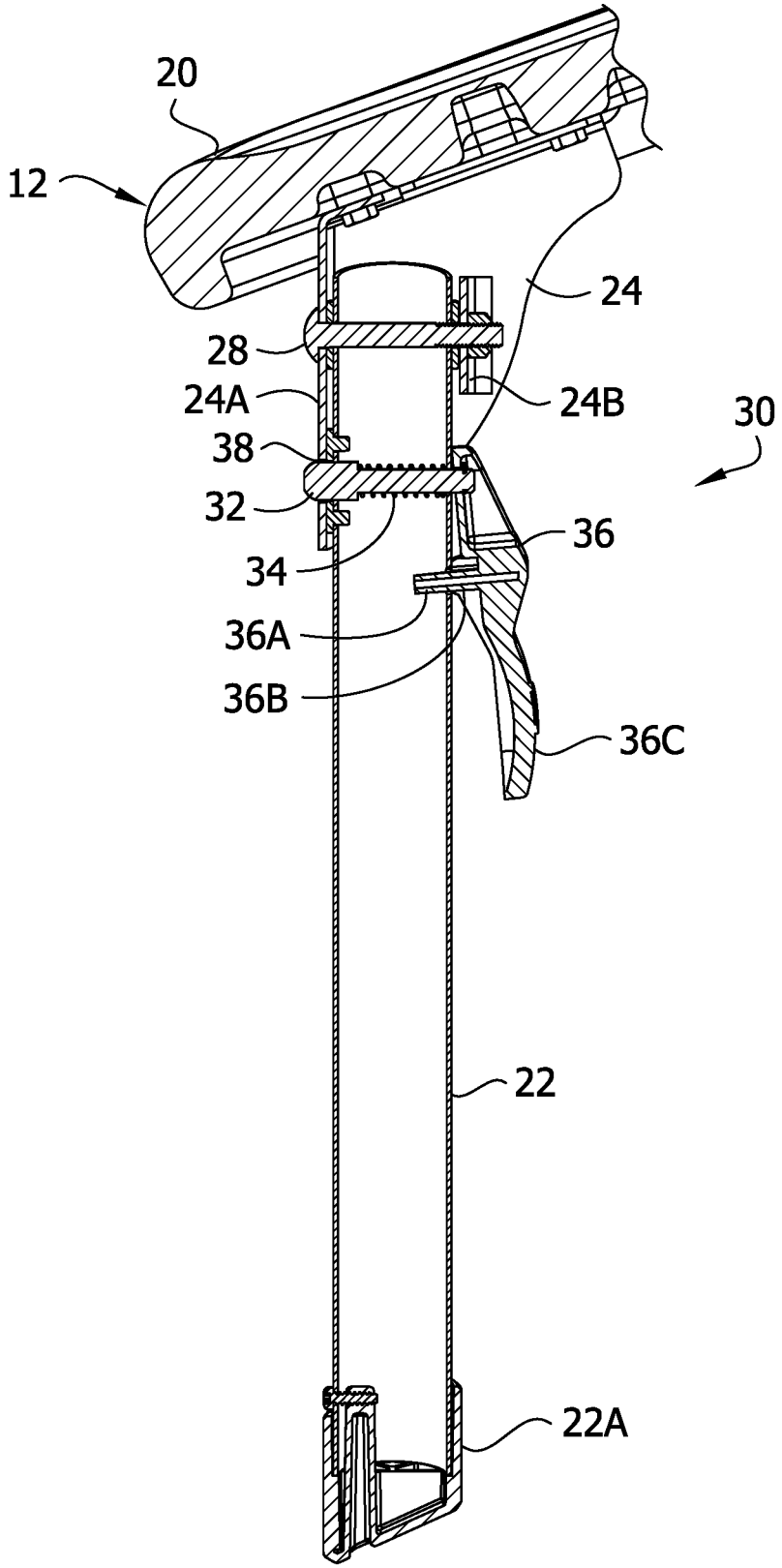
FIG. 9 is a section of a leg of a chair of the shooting bench taken in a plane including line 9-9 indicated in FIG. 6.

The legs 22 are selectively lockable in the stowed and deployed positions by pivot locks 30. As shown in FIGS. 7-9, each pivot lock 30 includes a shaft 32 (broadly, "retainer") extending through the proximal portion of the leg 22. The shaft 32 is biased by a spring 34 inside the leg 22 so a distal end of the shaft normally protrudes from the leg. Each pivot lock 30 also includes a lever 36 (broadly, "actuator") connected to a proximal end of the shaft 32 for moving the shaft against the bias of the spring 34. As shown in FIG. 9, a connection portion 36A of the lever 36 extends into an opening in the leg 22, and rounded tabs 36B on opposite sides of the connection portion are positioned to engage the outer surface of the leg 22 on opposite sides of the connection portion 36A to define a fulcrum about which the lever 36 is pivotable. The lever includes a push surface 36C that is pivotable toward the leg 22 about the fulcrum to pull the shaft 32 to compress the spring 34. The outer plates 24A of the leg brackets 24 include two holes 38 (broadly, "openings"). The arrangement is such that the springs 34 of the pivot locks 30 bias the respective shafts to protrude into one of the holes 38 to lock the leg in the corresponding position. The shaft 32 extends into one of the holes 38 when the associated leg is in the deployed position and extends into the other of the holes when the leg is in the stowed position. To pivot the leg 22 to the other position, the user can withdraw the shaft 32 from the hole 38 by pressing the push surface 36C of the lever 36 toward the leg. The leg 22 is thus unlocked for pivoting. As the leg 22 is pivoted to the other position, the distal end of the shaft 32 may ride on the plate 24A until reaching the other hole 38. The spring 34 causes the shaft 32 to "snap" into the other hole 38 to lock the leg 22 in the corresponding stowed or deployed position.

Chairs having other configurations can be used without departing from the scope of the present invention. For example, other types of seats (e.g., rotatable seats) can be used, and the chair could include a back rest. Moreover, other types of legs, types of leg connections, and numbers of legs, etc. can be used.

The table 14 includes a table top 40 and a plurality of legs 42 constructed to engage the ground surface to support the table top above the ground surface. The table top 40 has an upper support surface 40A sized and shaped to support a firearm to be fired by the shooter and/or to support one or more rests on which the firearm is supported. For example, the table top 40 can be made of plastic, or another suitable material. In the illustrated embodiment, the table top 40 is generally T-shaped, including a relatively wide forward section (defining a front edge of the table top) and a relatively narrow rearward section (defining a rear edge of the table top). The rearward section is narrower because the table top 40 includes side indentations rearward from the forward section, providing the table top 40 with the generally T-shape. The table top 40 defines a table axis TA (FIG. 3) extending between the rearward and forward sections of the table top. In use, the table axis TA is usually generally aligned with the intended target of the shooter. The firearm would usually be positioned above the table top 40 (e.g., resting on a shooting rest on the upper support surface 40A) generally aligned with the table axis TA for aiming at the target.

In the illustrated embodiment, the table 14 includes two legs 42. The legs have proximal or upper portions connected to the forward section of the table top 40 and distal or lower portions having feet 42A for engaging the ground surface. The connection of the table legs 42 to the table top 40 is constructed essentially the same as the connection of the chair legs 22 to the seat 20. The proximal portions of the legs 42 are pivotally connected to leg brackets 44 that are secured to a bottom of the table top 40. The proximal portions of the table legs 42 are connected to outer plates 44A and inner tabs 44B of the brackets 44 by pin connections 46 (e.g., bolts) and are pivotable about the pin connections between stowed positions and deployed positions. In the deployed position, the legs 42 extend from the brackets 44 downward and at a slight angle forward and laterally outward to position the feet 42A for engagement with the ground surface to support the table top above the ground surface. In the illustrated embodiment, the table 14 is not self-supporting. The legs 42 support the forward section of the table top 40. The linkage 16 connecting the table 14 to the chair 12 supports the rearward section of the table top 40. In other embodiments, the table can be self-supporting. In the stowed positions, the legs 42 extend along the bottom of the table top 40 generally parallel with the table top.

Figure 5:
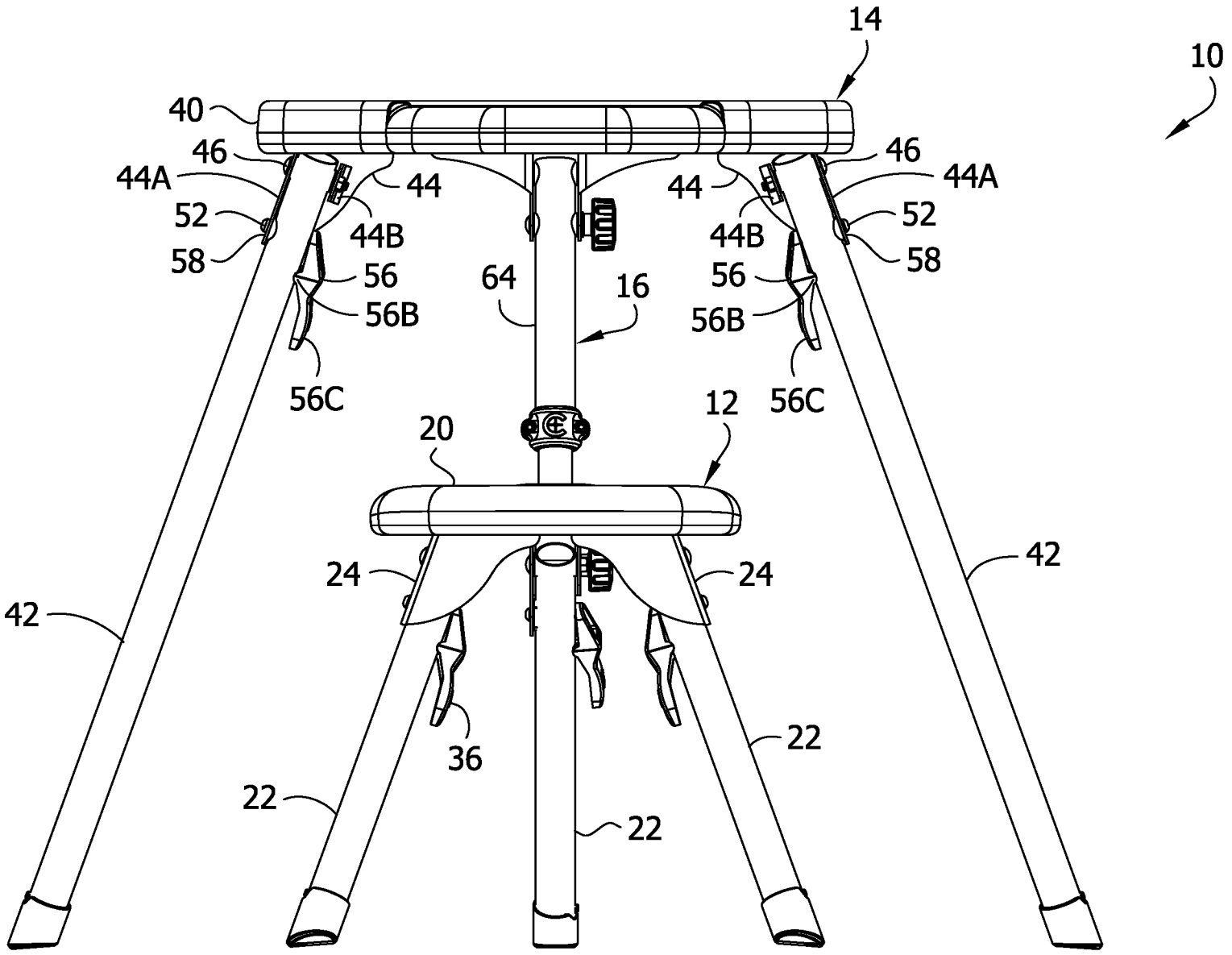
FIG. 5 is a rear view of the shooting bench.
Figure 6:
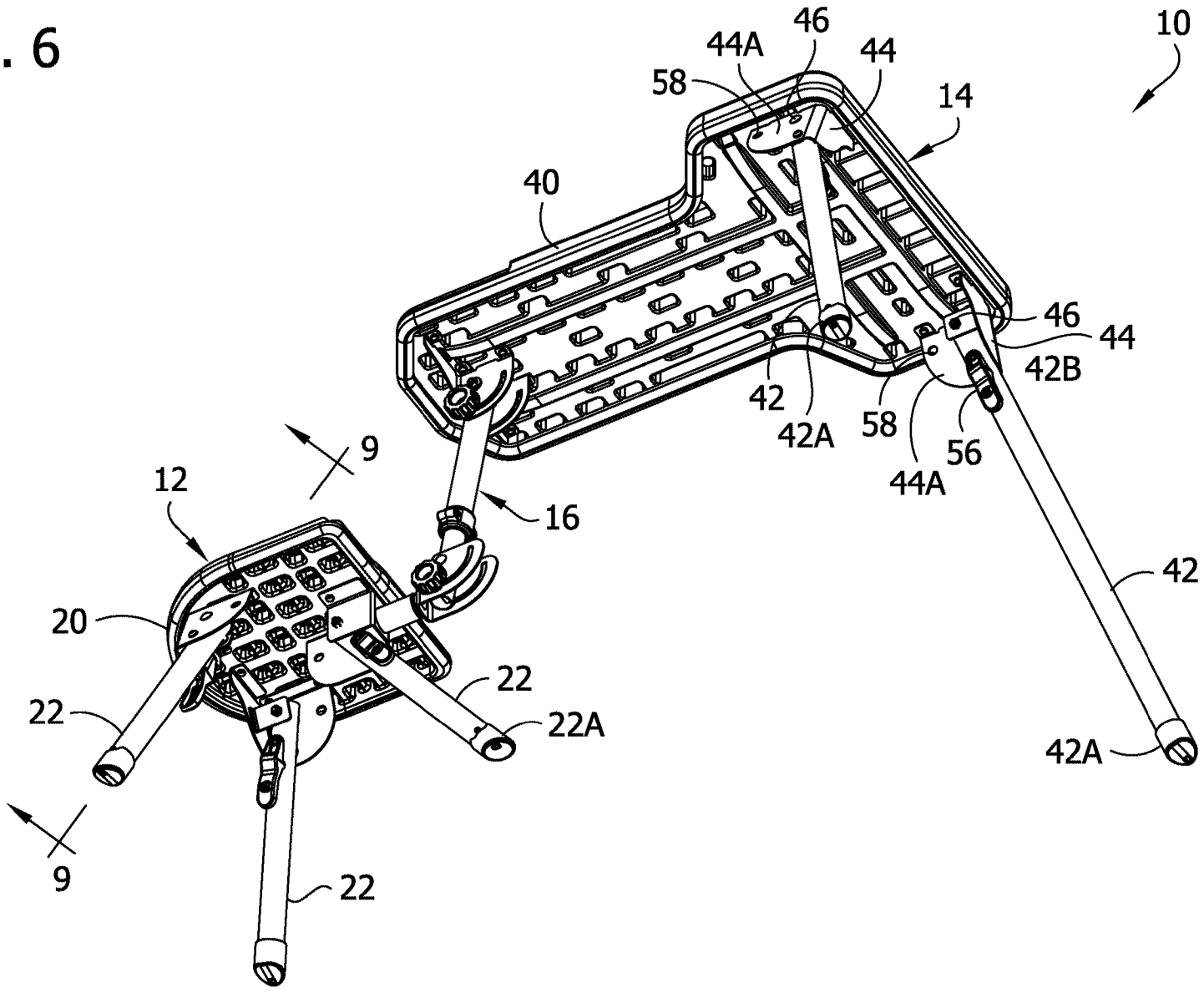
FIG. 6 is a bottom perspective of the shooting bench.

Similar to the chair legs, the table legs are selectively lockable in the stowed and deployed positions by pivot locks 50. As shown in FIG. 5, each pivot lock includes a shaft 52 (broadly, "retainer") extending through the proximal portion of the leg 42. The shaft 52 is biased by a spring (not shown) inside the table leg 42 in the same fashion as the spring 34 shown in the chair leg in FIG. 9. Each pivot lock 50 also includes a lever 56 (broadly, "actuator") connected to the shaft 52 for moving the shaft against the bias of the spring. The lever 56 includes a connecting portion (not shown but similar to the connecting portion 36A in FIG. 9), and protruding rounded tabs 56B that act as a fulcrum in engagement with the leg 42 as with the chair pivot locks 30. The lever 56 includes a push surface 56A pivotable toward the leg 42 about the fulcrum to pull the shaft 52 to unlock the respective leg 42. The outer plates 46A of the leg brackets 46 include two holes 58 (broadly, "openings"). As with the chair leg locks 30, the arrangement of the table leg locks 50 is such that the shaft 52 is biased to protrude into one of the two holes 58 to lock the leg 42 in the corresponding position. To pivot the leg 42 to the other position, the user can withdraw the shaft 52 from the hole 58 by pressing the push surface 56C of the lever 56 toward the leg 42. The leg 42 is thus unlocked for pivoting. As the leg 42 is pivoted to the other position, the distal end of the shaft 52 may ride on the plate 46A until reaching the other hole 58. The shaft 52 "snaps" into the other hole 58 to lock the leg 42 in the corresponding stowed or deployed position.

Tables having other configurations can be used without departing from the scope of the present invention. For example, other types of table tops can be used. Moreover, other types of legs, types of leg connections, and numbers of legs, etc. can be used.

Referring now to FIGS. 6-8, 10, and 11, the linkage 16 (broadly, "table support structure") includes an articulating arm 60 extending from the chair 12 to the table 14. The arm 60 includes four joints defining four pivot axes PA1, PA2, PA3, PA4 to permit articulation of the arm. As will become apparent, the linkage 16 is configured to permit adjustment of the shooting bench 10 from the stowed configuration to the deployed configuration. Moreover, the linkage 16 is configured to permit adjustment of the shooting bench in the deployed configuration between the neutral arrangement (e.g., FIG. 1, 3) and the right-handed arrangement (e.g., FIGS. 12, 13) and left-handed arrangement (not shown).

Figure 11:
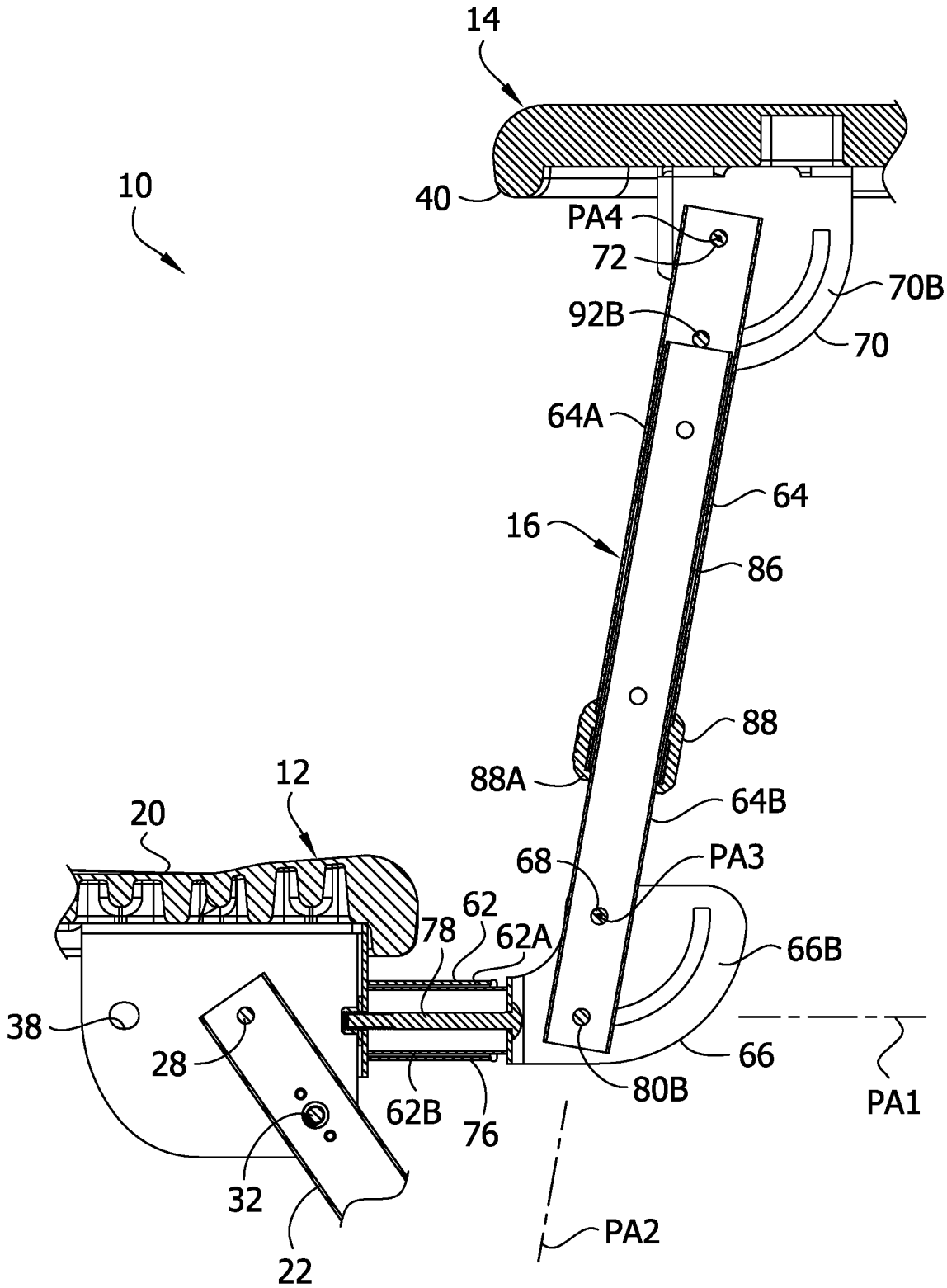
FIG. 11 is a fragmentary section of the shooting bench taken in a plane including line 11-11 indicated in FIG. 4.
Figure 12:
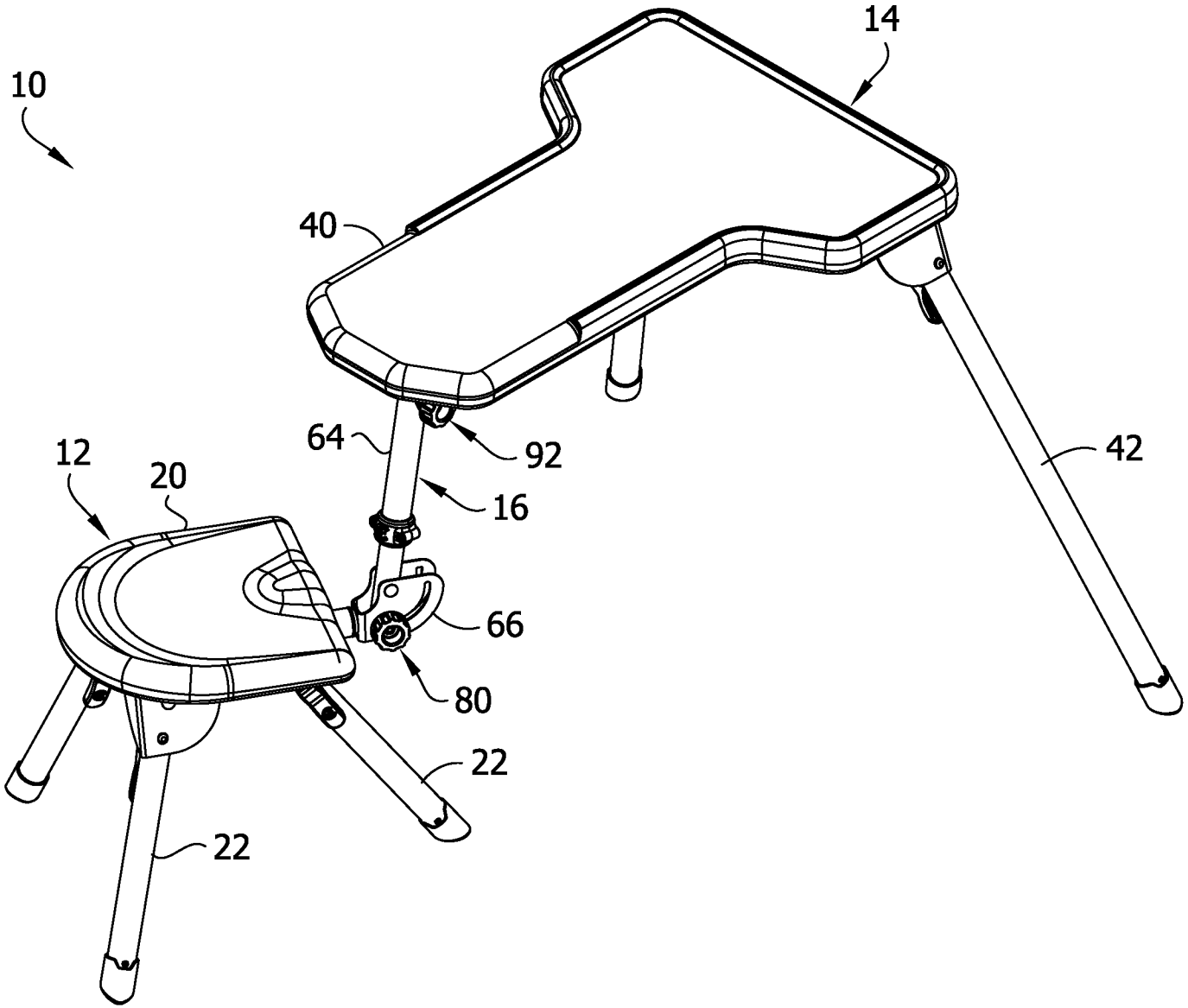
FIG. 12 is a rear perspective of the shooting bench of FIG. 1 adjusted from the deployed, neutral configuration to a deployed, right-handed shooter configuration.

Referring to FIGS. 7 and 11, the articulating arm 60 includes a lower generally horizontal first portion 62 extending forward from the chair and a second portion or post 64 extending upward toward the table top 40. The first portion 62 defines a first joint of the arm 60 and an associated first pivot axis PA1. The post 64 defines a second joint of the arm 60 and an associated second pivot axis PA2. The first portion 62 and a lower end of the post 64 are connected by a lower pivot mount 66 and pivot connection 68 defining a defining a third joint and associated third pivot axis PA3. An upper end of the post 64 and the table top 40 are connected by an upper pivot mount 70 and pivot connection 72 defining a fourth joint and associated fourth pivot axis PA4.

The first portion 62 of the arm is secured to a front of the front chair leg bracket 24. Referring to FIG. 11, the first portion 62 includes an outer round tube 62A secured to the front chair leg bracket 24. An inner round tube 62B having slightly smaller diameter is received in the outer tube 62A. A sleeve 76 made of a low friction material is positioned between the inner and outer tubes 62A, 62B to facilitate axial pivoting of the inner tube with respect to the outer tube about the first pivot axis PA1. The inner tube 62B is secured (e.g., welded) to the lower pivot mount 66. As shown in FIG. 11, the lower pivot mount 66 is secured to the front leg bracket 24 of the chair 12 by a bolt 78, which fixes the inner tube 62B axially with respect to the outer tube 62A to maintain the inner tube in the outer tube but permits axial rotation of the inner tube about the first pivot axis PA1.

Figure 10:
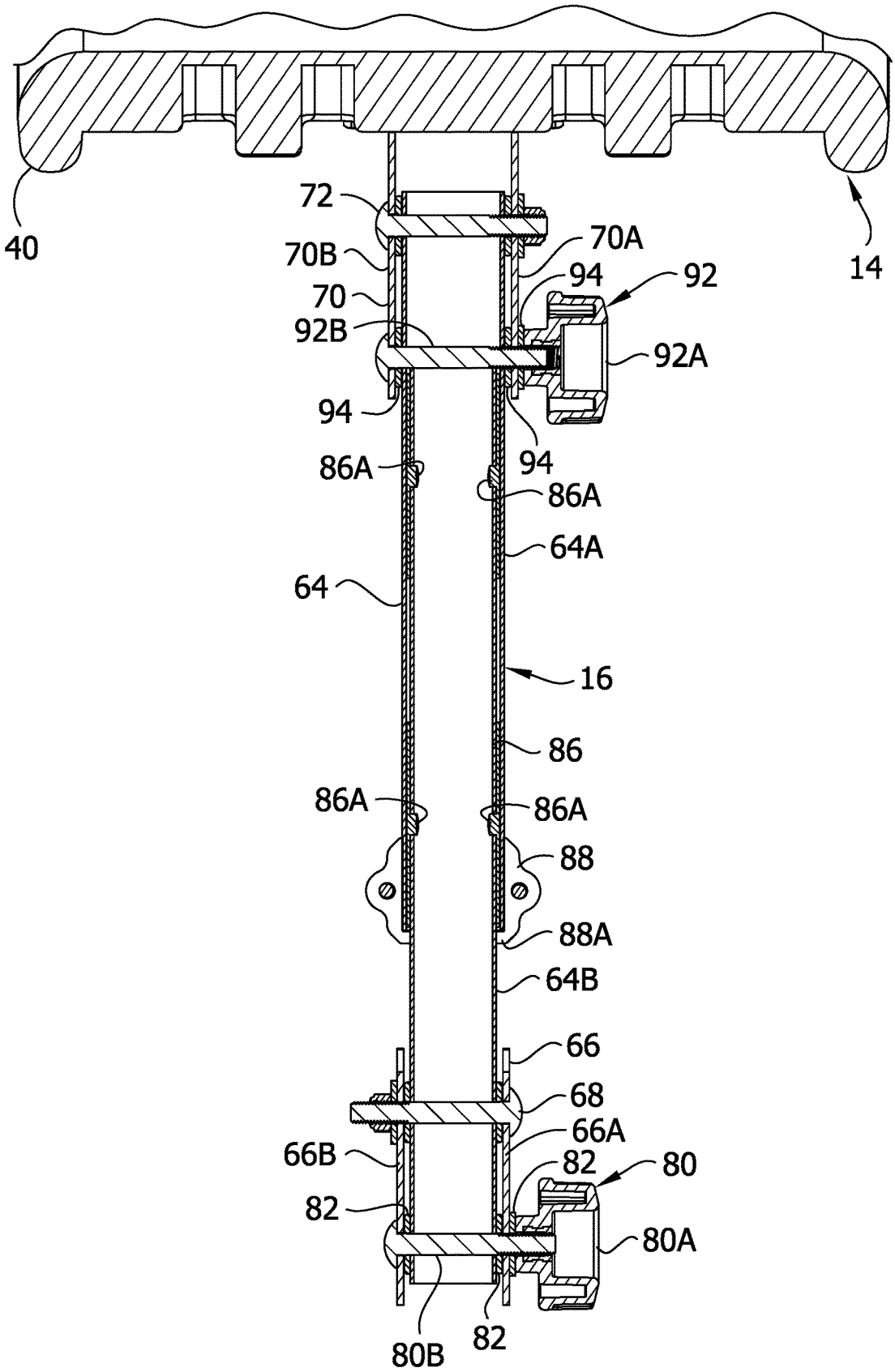
FIG. 10 is a section of a linkage of the shooting bench taken in a plane including line 10-10 indicated in FIG. 2.

The lower pivot 66 mount includes two spaced apart wings 66A, 66B between which the bottom end of the post 64 is pivotally connected by a bolt 68. A pivot lock 80 is provided for selectively locking and unlocking the joint to permit and lock pivoting of the post 64 with respect to the pivot mount 66 about the third pivot axis PA3. The pivot lock 80 includes a knob 80A (broadly, "actuator") and a carriage bolt 80B (broadly, "fastener") extending through the wings 66A, 66B of the lower pivot mount 66 and through the lower end of the post 64. As shown in FIG. 10, washers 82 are provided between the lower end of the post 64 and the respective wings 66A, 66B and another washer 82 is provided between the knob 80A and the adjacent wing 66A. The knob 80A is threaded onto a threaded shaft of the carriage bolt 80B. As shown in FIGS. 7 and 8, the carriage bolt 80B extends through arcuate slots in the wings 66A, 66B defining a pivot guide or track. A square neck of the carriage bolt 80B is received in one of the arcuate slots and prevents rotation of the carriage bolt in the arcuate slot but permits sliding of the bolt along the slot. The arrangement is such that the knob 80A can be rotated to thread farther onto the carriage bolt 80B to lock the joint and rotated to thread away from the lower pivot mount 66 to unlock the joint. When the knob 80A is loosened, the post 64 can be pivoted about the third pivot axis PA3 to any desired position in a range of movement of the bolt 80B along the arcuate slots, and the arm can be locked in that position by threading the knob farther onto the bolt. Rotating the knob 80A to thread farther onto the bolt pulls the head of the carriage bolt 80B toward the knob to compress the lower portion of the post 64 with the wings 66A, 66B and washers 82, creating sufficient friction to lock the joint.

Referring to FIG. 10, the post includes an upper round tube 64A and a lower round tube 64B of slightly smaller diameter received in the upper round tube. The lower round tube 64B defines the lower end of the post 64 and is pivotally connected to the lower pivot mount 66 by the bolt 68. A sleeve 86 of low friction material is positioned between the inner and outer tubes 64A, 64B to facilitate axial pivoting of the inner tube with respect to the outer tube about the second pivot axis PA2. The sleeve 86 is secured to the inner tube 64B by circular nubs 86A (FIG. 10) extending radially inward from the sleeve into openings in the inner tube. A collar 88 is mounted to the lower end of the outer tube 64A and includes a flange 88A extending radially inward at the end of the outer tube to underlie a lower end of the sleeve 86. Engagement of the collar flange 88A with the lower end of the sleeve 86 prevents the inner tube 64B from being withdrawn axially from the outer tube 64A, thus maintaining the inner tube in the outer tube.

An upper end of the outer tube 64A and thus and upper end of the post 64 is pivotally connected to the upper pivot mount 70 by a bolt 72 defining the fourth pivot axis PA4. The upper pivot mount 70 is secured to the table top 40 by fasteners (e.g., screws) and includes two spaced apart wings 70A, 70B to which the upper end of the post 64 is connected by the bolt 72. A pivot lock 92 is provided for selectively locking an unlocking the joint to permit and lock pivoting of the post 64 with respect to the upper pivot mount 70 about the fourth pivot axis PA4. The pivot lock 92 includes a knob 92A (broadly, "actuator") and a carriage bolt 92B (broadly, "fastener") extending through the wings 70A, 70B of the upper pivot mount 70 and through the upper end of the post 64. As shown in FIG. 10, washers 94 are provided between the upper end of the post 64 and the respective wings 70A, 70B, and another washer 94 is provided between the knob 92A and the adjacent wing 70A. The knob 92A is threaded onto a threaded shaft of the carriage bolt 92B. As shown in FIGS. 7 and 8, the carriage bolt 92B extends through arcuate slots in the wings 70A, 70B defining a pivot guide or track. A square neck of the carriage bolt 92B is received in one of the arcuate slots and prevents rotation of the carriage bolt in the arcuate slot but permits sliding movement of the bolt along the arcuate slot. The arrangement is such that the knob 92A can be rotated to thread farther onto the bolt 92B to lock the joint and rotated to thread away from the pivot mount 90 to unlock the joint. When the knob 92A is loosened, the post 64 can be pivoted about the fourth pivot axis to any desired position in a range of movement of the bolt 92B along the arcuate slots and can be locked in that position by rotating the knob to thread farther onto the bolt. Rotating the knob 92A to thread onto the carriage bolt 92B pulls the head of the bolt toward the knob to compress the upper portion of the post 64 with the wings 70A, 70B and washers 94, creating sufficient friction to lock the joint.

Although not exactly analogous, the pivot axes PA1-PA2 outlined above can be described by reference to the common aircraft principal axes of roll, pitch, and yaw. For example, the first pivot axis PA1 can be referred to as a roll pivot axis about which the chair 12 or table 14 pivots in a generally roll direction with respect to the other of the chair or table. The second pivot axis PA2 can be referred to as a yaw pivot axis about which the chair 12 or table 14 pivots in a generally yaw direction with respect to the other of the chair or table. Finally, the third and fourth pivot axes PA3, PA4 can be referred to as pitch pivot axes about which the chair 12 or table 14 pivots in a generally pitch direction with respect to the other of the chair or table.

Figure 2:
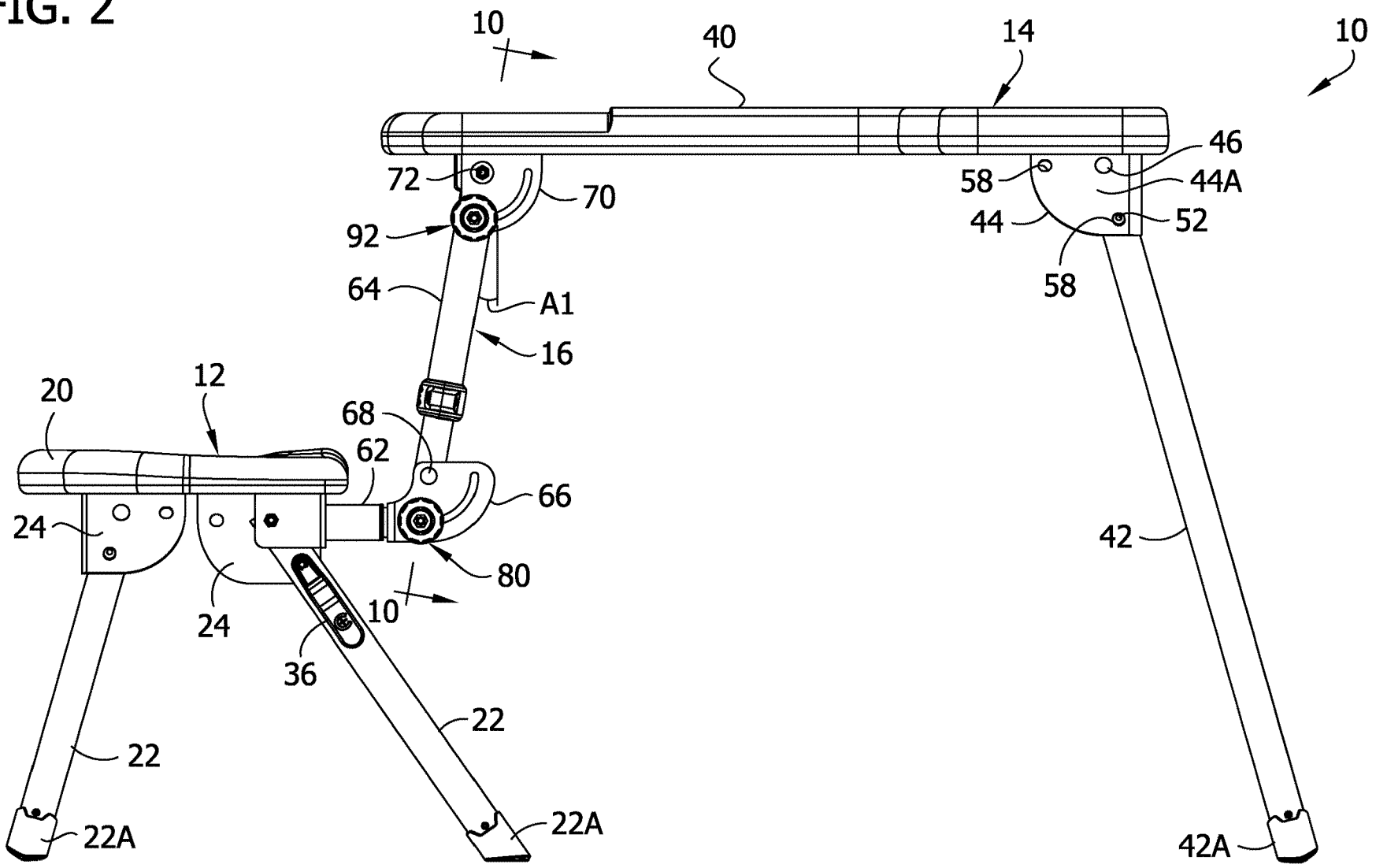
FIG. 2 is a right elevation of the shooting bench of FIG. 1.

It will be appreciated that the linkage 16 is constructed to support the rear section of the table top 40 as would a rear leg of the table 14 and also permits the chair 12 to be moved to customized positions with respect to the table as desired by different shooters. In a first adjustment feature, when the shooting bench 10 is in the deployed position, the chair 12 can be moved closer to or farther from the table 14. For example, as shown in FIG. 2, the chair 12 is shown as far rearward from the table 14 as permitted by the linkage 16. If the shooter is smaller in stature, the shooter may prefer to move the chair 12 closer to the table 14. This can be accomplished by unlocking the upper and lower pivot locks 92, 80, moving the chair 12 forward relative to the table 14, and relocking the upper and lower pivot locks. It will be appreciated that in the configuration shown in FIG. 2, the post 64 extends downward and rearward from the table top at a slight skew angle A1 (FIG. 2) with respect to vertical (e.g., in the inclusive range of about 5 degrees to about 20 degrees, or in the inclusive range of about 10 degrees to about 20 degrees, such as about 15 degrees). This provides enhanced stability of the table 14 against forces tending to move the table top 40 rearward. If the chair 12 is moved forward, the skew angle A1 would reduce (e.g., to zero) but the table 14 would still be sufficiently stable because of the support provided by the linkage 16 connecting to the chair 12 on which the shooter is sitting. Such movement of the chair 12 forward toward the table 14 can be used to raise the elevation of the rear end of the table top 40 because the post 64 becomes more vertical.

In a second adjustment feature, the upper and/or lower pivot lock 92, 80 can be loosened to permit pivoting about the associated pivot axis PA3, PA4 to change the elevation of the feet 22A of the chair 12 with respect to the feet 42A of the table 14. This may be useful for adjusting the shooting bench 10 to engage all five feet 22A, 42A with the ground surface in conditions where the ground surface is uneven or not planar. When the adjustment is completed, the upper and/or lower pivot lock 92, 80 can be retightened.

In a third adjustment feature, the chair 12 can be rotated laterally with respect to the table top 40 for adjusting the shooting bench 10 for right-handed and left-handed shooters. For example, the shooting bench 10 can be adjusted from the neutral configuration (e.g., FIGS. 1-6) to the right-handed shooter configuration (e.g., FIGS. 12-15) by pivoting the chair 12 laterally to the left with respect to the table 14. This can be accomplished by pivoting the chair 12 about the second pivot axis PA2. It will be appreciated that because the post 64 extends downward and rearward at a skew angle A1 with respect to vertical, pivoting of the chair 12 purely about the second pivot axis PA2 to the left may cause the rear left foot 22A of the chair to be lower than the rear right foot 22A of the chair such that the rear right chair foot does not contact the ground surface. However, pivoting the chair 12 about the first pivot axis PA1 permits the chair legs 22 to be moved with respect to the ground surface to level the feet 22A with respect to the ground surface and bring all three chair feet into engagement with the ground surface. In other words, pivoting about the first pivot axis PA1 compensates for the chair pivoting out of level with the ground surface when the chair is pivoted about the non-vertical second pivot axis PA2. It will be appreciated that pivoting about the first pivot axis PA1 may not be required if the post 64 is arranged to be vertical instead of at a skew angle A1 with respect to vertical.

Figure 13:
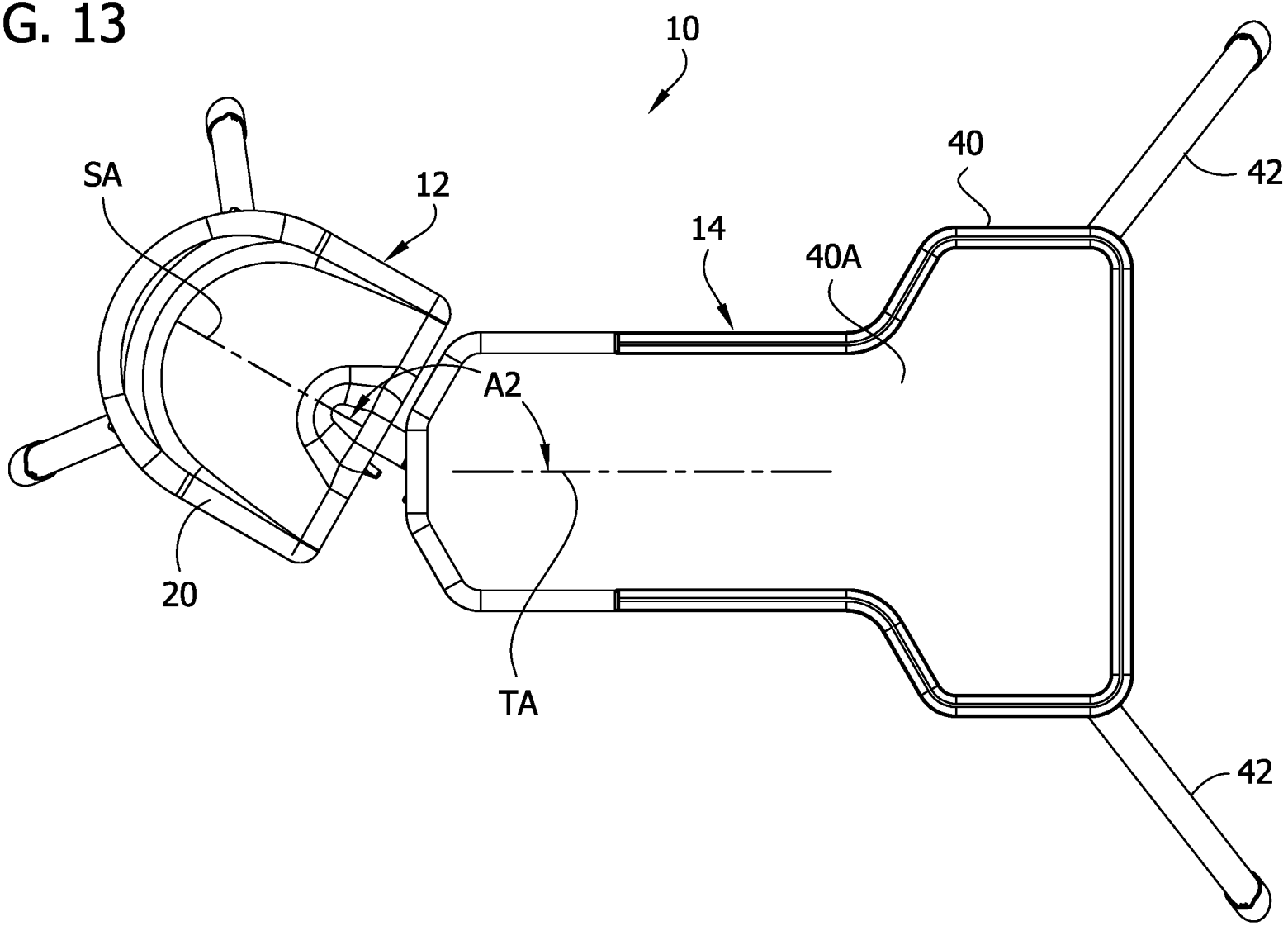
FIG. 13 is a top view of the shooting bench of FIG. 12.
Figure 14:
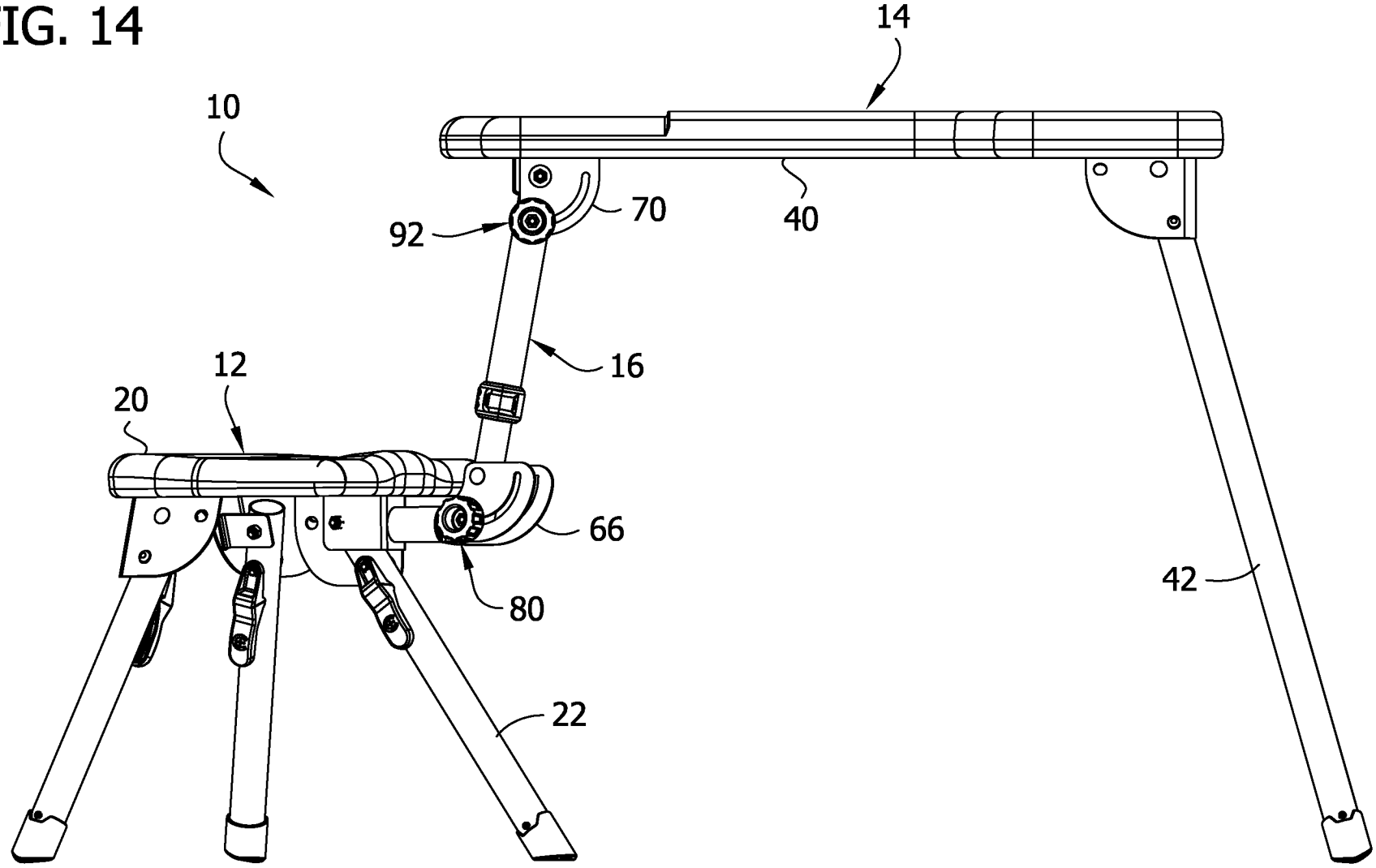
FIG. 14 is a right elevation of the shooting bench of FIG. 12.
Figure 15:
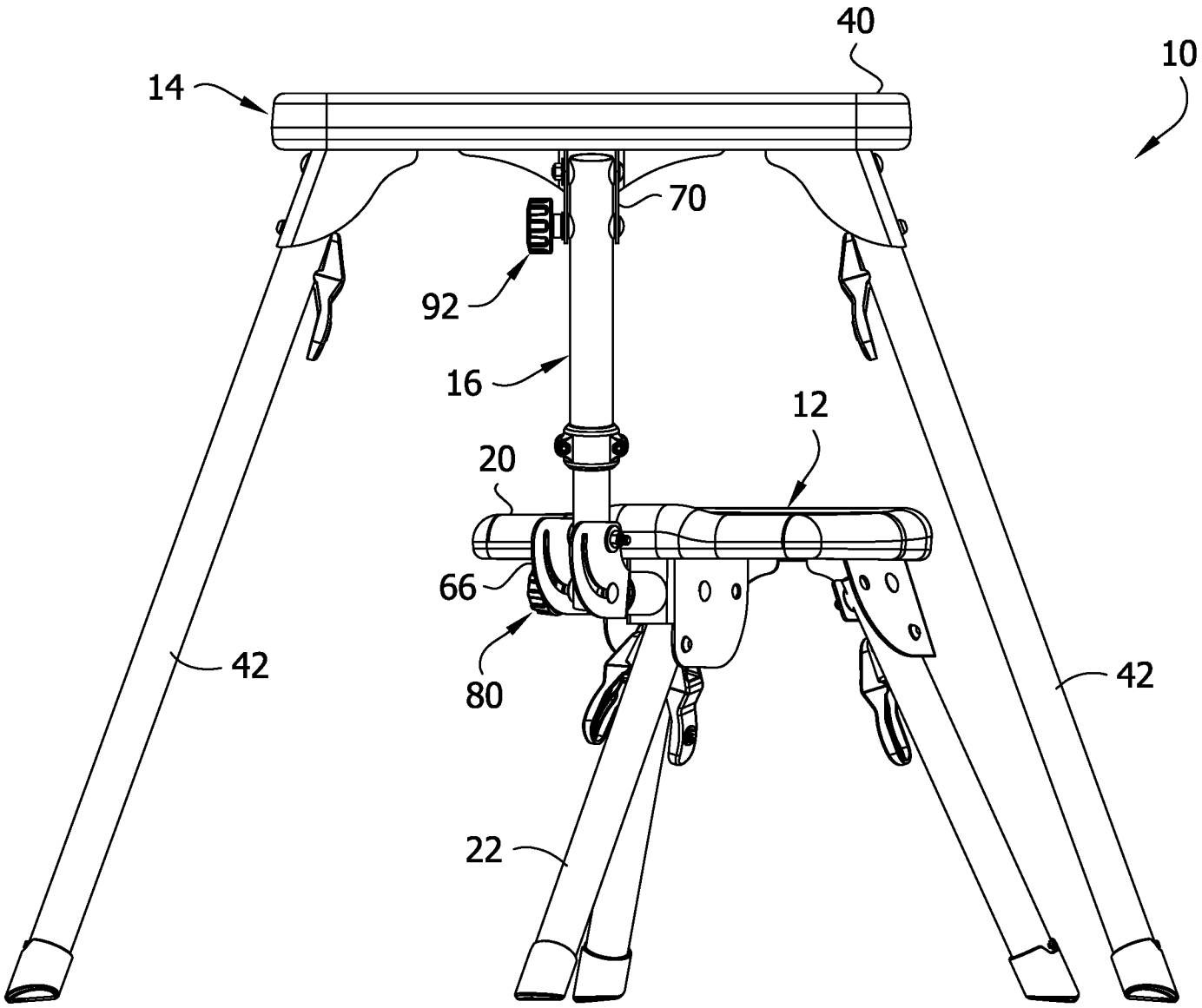
FIG. 15 is a front elevation of the shooting bench of FIG. 12.

As shown in FIG. 13, when the shooting bench 10 is arranged in the right-handed shooter configuration, the seat axis SA extends at a skew angle A2 with respect to the table axis. It is believed shooters are more comfortable shooting with their chest and torso facing in a direction offset with respect to the direction the firearm is aiming, and the adjustability of the linkage 16 permits lateral pivoting of the chair 12 (e.g., up to 45 degrees or more) with respect to the table 14 to meet a shooters desired shooting position. As shown by comparison of FIGS. 4 and 15, no matter the pivoted position of the chair 12 with respect to the table 14, the post 64 remains in a generally upright orientation (left-to-right) for providing support to the rear section of the table top 40. Although not illustrated, it will be appreciated that the chair 12 can be pivoted with respect to the table 14 to a left-handed shooter configuration in which the chair is moved from the neutral position in a similar manner as described above but laterally to the right rather than to the left.

In one aspect of the shooting bench 10, the shooter's weight is transferred from the seat 20 to the ground surface through the chair legs 22 such that the table 14 is isolated from the burden of bearing the weight of the shooter. The table is subjected to some lateral loading on the chair transferred to the table by the linkage 16, but that can be minimal compared to the force of the weight of the shooter on the chair 12. If, for example, the chair had only the two rear legs 22, the user's weight would be partially transferred through the table top 40 and the legs 42 of the table 14 to the ground surface. Slight movements of the shooter would cause the table top 40 and thus a firearm resting on the table top to shake or perhaps shift. This would be counterproductive and frustrating to the shooter if they were trying to precisely aim a firearm resting on the table top 40. In other words, the chair 12 having sufficient engagement with the ground (e.g., three feet 22A) to be fully self-supporting apart from support by the table 13 via the linkage 16 improves the stability of the table top 40 for more steadily supporting a firearm. Other arrangements can be used without departing from the scope of the present invention.

It will be appreciated that other types of table support structure, such as other types of linkages, etc. can be used without departing from the scope of the present invention. For example, the table support structure can extend to the ground surface for providing added stability. The table support structure can define fewer joints, pivot axes, and/or fewer pivot connections. Multiple pivot axes can be defined by a single pivot connection. Moreover, although the linkage extends upward from the chair to the table in a single arm, multiple arms or a framework can be provided, etc. without departing from the scope of the present invention.

Figure 17:
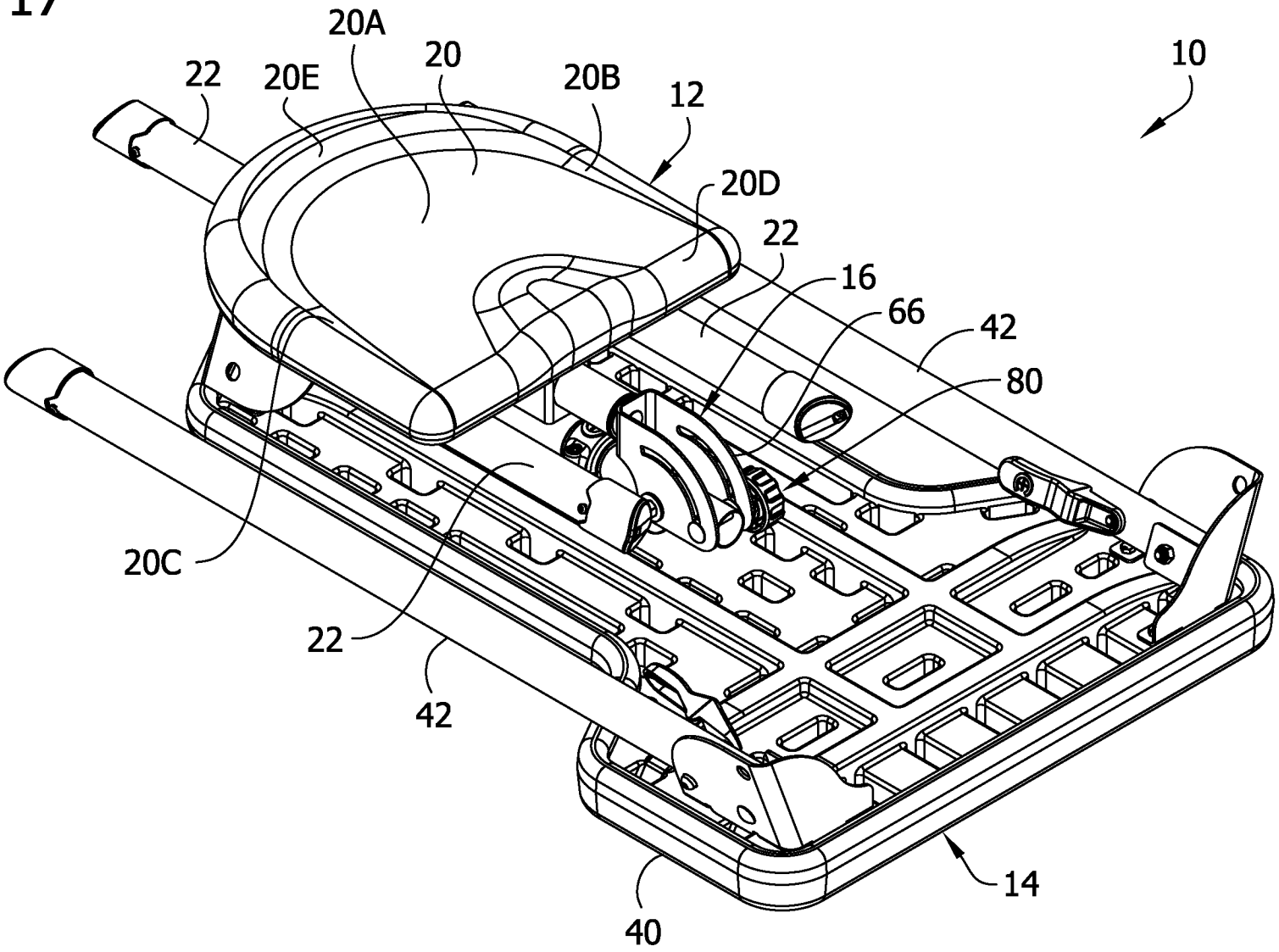
FIG. 17 is a bottom perspective of the shooting bench of FIG. 16.
Figure 20:
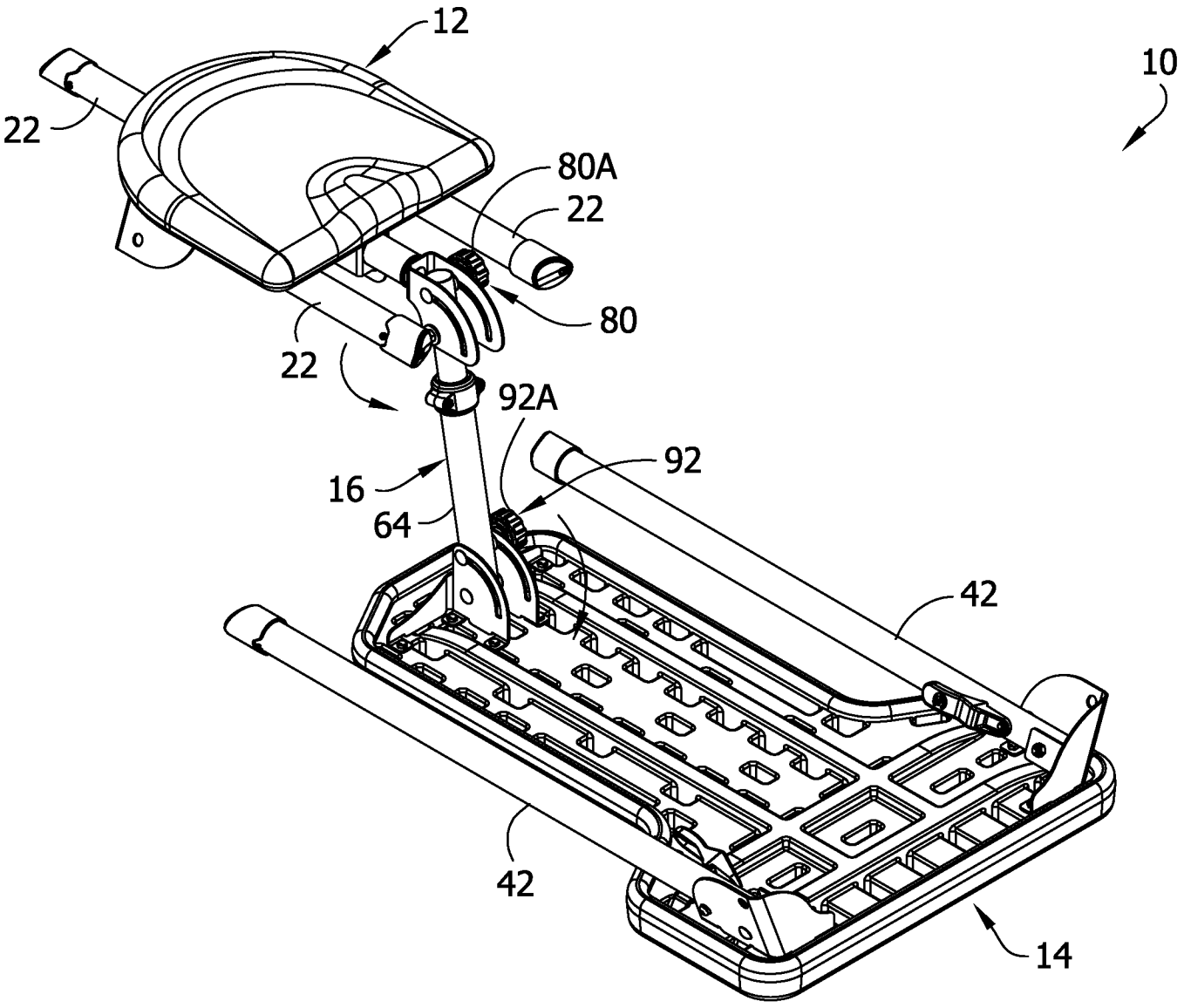
FIG. 20 is a bottom perspective of the shooting bench in a partially collapsed configuration.

As mentioned above, the shooting bench 10 is intended to be portable and can relatively easily be changed between the deployed configuration to the stowed configuration shown in FIGS. 16-19. The shooting bench 10 can be collapsed to the stowed configuration in relatively few steps and without disassembling any of the components or joints of the shooting bench. In a first step, the shooting bench 10 may be flipped over so the top of the table top 40 is resting on the ground surface. The chair 12 is rotated 180 degrees about the first pivot axis to invert the seat 20. All of the table and chair legs 42, 22 can be moved to their stowed positions. The shooting bench 10 is shown in this partially stowed configuration in FIG. 20. When the upper and lower pivot locks 92, 80 are loosened by unthreading the knobs 92A, 80A, the chair 12 is collapsed toward the table top 40 by pivoting the post 64 about the fourth pivot axis PA and the seat 20 about the third pivot axis PA3. This may be referred to as a "Z" fold. When the post 64 is pivoted to be generally parallel with the table top 40, and the seat 20 is generally parallel with the post 64, the pivot locks 92, 80 are locked by tightening the knobs 92A, 80A. This secures the shooting bench 10 in the stowed configuration, as shown in FIG. 17. These steps can be completed in reverse order to change the shooting bench 10 to the deployed configuration.

Figure 18:
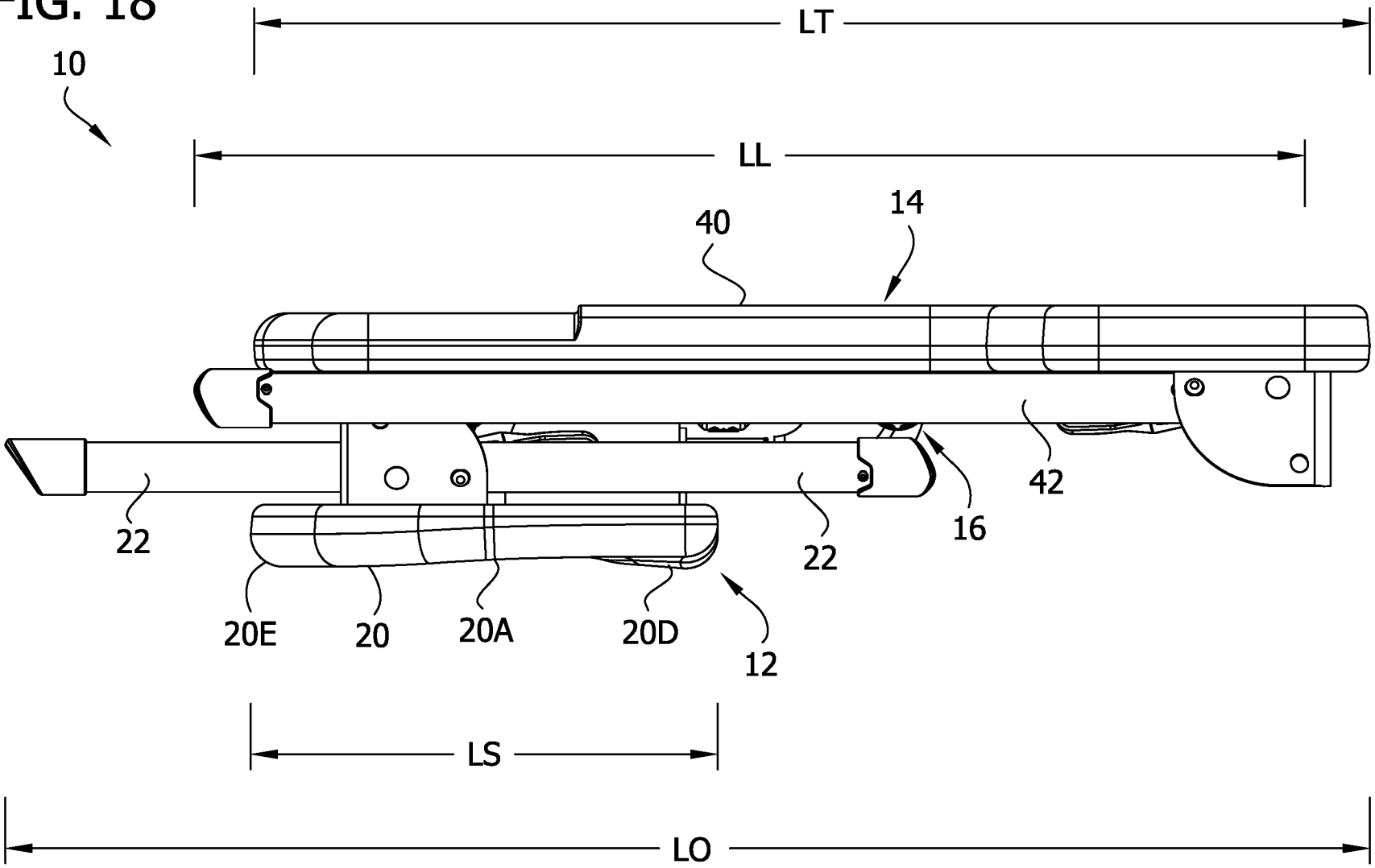
FIG. 18 is a side elevation of the shooting bench of FIG. 16.
Figure 19:
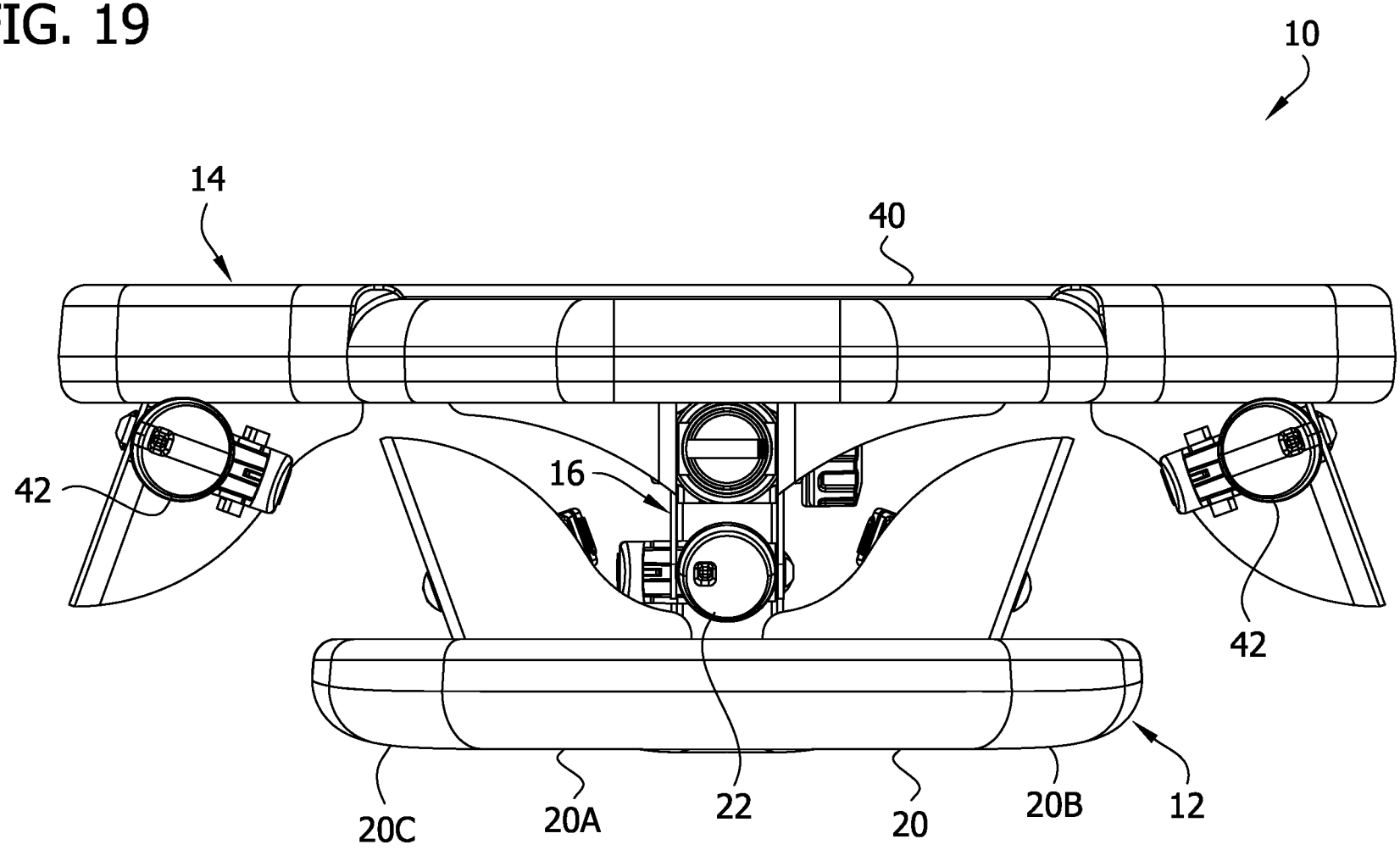
FIG. 19 is a rear elevation of the shooting bench of FIG. 16.

In the stowed configuration, the shooting bench 10 is relatively compact and flat for ease of transportation and storage. The legs 22, 42 extend alongside and between the table top 40 and the seat 20, and the legs do not extend substantially forward or rearward beyond the extents of the respective front and rear sections of the table top. Desirably, each leg 42 (and any other table leg if provided) does not extend forward of the front edge of the table top 40 or rearward of the rear edge of the table top more than 40 percent of the length LL of the leg, more desirably not more than 30 percent of the length of the leg, more desirably not more than 25 percent of the length of the leg, even more desirably not more than 20 percent of the length of the leg. As shown in FIG. 18, in the illustrated embodiment, the legs 42 extend about 6 percent of the length LL of the legs rearward outboard of the rear edge of the table top 40. In the stowed configuration, the sitting area 20 is substantially within the footprint (periphery) of the table top 40 (e.g., at least 50 percent within the footprint of the table top, more desirably at least 75 percent within the footprint of the table top). For example, the length LS of the seat sitting area 20 is desirably at least 50 percent between the front and rear edges of the table top 40, more desirably at least 60 percent between the front and rear edges of the table top, and even more desirably at least 75 percent between the front and rear edges of the table top. As shown in FIG. 18, in the illustrated embodiment, almost the entirety of the length LS of the sitting area 20 is between the front and rear edges of the table top 40. In another aspect, the overall length LO of the shooting bench in the stowed configuration is desirably not greater than 150 percent of the length LT of the table top, more desirably not greater than 140 percent of the length of the table top, more desirably not greater than 130 percent of the length of the table top, even more desirably not greater than 125 percent of the length of the table top. As shown in FIG. 18, in the illustrated embodiment, the overall length LO of the stowed shooting bench 10 is about 123 percent of the length LT of the table top 40. The stowed shooting bench 10 has a height not substantially greater than the combined thickness of the table top 40, post 64, chair legs 22 or table legs 42, and seat 20. The arrangement is such that the shooting bench 10 provides a significantly improved compact stowed configuration and is easier to change to the deployed configuration because there is no need to assemble any parts separated for storage. In the illustrated embodiment, the linkage 16 does not need to be disconnected from the chair 12 or the table 14 to change from the deployed configuration to the stowed configuration. Desirably, the shooting bench 10 weighs less than 40 pounds, and even more desirably less than 30 pounds. Although the shooting bench 10 is lightweight and capable of a compact stowed configuration, the shooting bench desirably is sturdy and robust enough to support a relatively heavy shooter, such as a shooter weighing at least 200 pounds, more desirably a shooter weighting at least 250 pounds. The components of the shooting bench 10 can be made of various suitable materials, such as metal and plastic.

Figure 21:
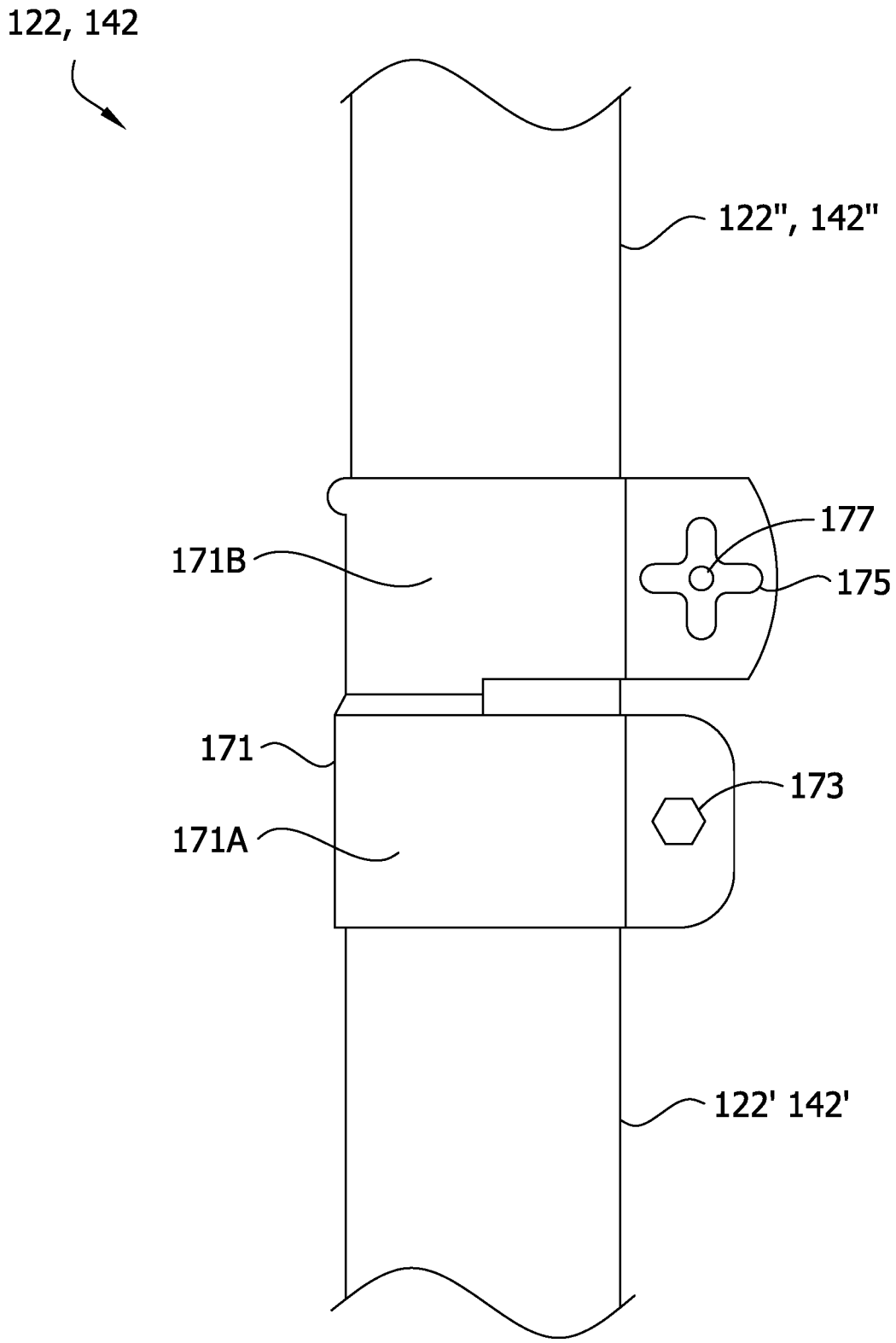
FIG. 21 is a fragmentary elevation of an alternative embodiment of a chair leg or table leg for the shooting bench of FIG. 1.

Referring to FIG. 21, an alternative embodiment of a leg that could be used for the chair 12 or the table 14 is indicated generally by the reference numbers 122, 142. In this embodiment, the leg 122, 142 is adjustable in length. It will be appreciated that the adjustable length leg 122, 142 could be used in place of one or more of the legs 22, 42 for the chair 12 or the table 14. The adjustable length leg includes a lower section 122', 142' and an upper section 122", 142"

telescopically received in the lower section. It will be understood that the upper section 122", 142", would be suitably secured to the seat 20, or table top 40, and the lower section would have a foot for engaging the ground surface. A lock 171 is provided for locking the length of the leg 122, 142. The lock 171 includes a lower collar 171A having two flanges secured together by a fastener 173 to clamp the lower collar on the lower leg section 122', 142'. An upper collar 171B is connected to the lower collar 171A and surrounds the upper leg section 122", 142". The upper collar 171B includes two flanges secured together by a fastener 177 and a knob 175 threaded onto the fastener. The upper collar 171B clamps the upper leg section 122", 142" when the knob 175 is threaded to a locking position on the fastener 177. To adjust the length of the leg 122, 142, the knob 175 is loosened on the fastener 177 to unclamp the upper collar 171B, permitting the upper leg section 122", 142" to telescope into or out of the lower leg section 122', 142'. When the desired length is achieved, the knob 175 is tightened to clamp the upper collar 171B on the upper leg section 122", 142" to lock the leg 122, 142 in the adjusted length. Such length adjustments may be useful to adjust the height of the shooting bench 10 for shooters of different sizes and/or to engage all of the legs with the ground surface in uneven terrain. It will be appreciated that a similar telescoping adjustment feature could be implemented in the linkage 16 (e.g., in the post 64).

As used herein, the term "front edge" means the forward most edge of the pertinent structure. Moreover, the term "rear edge" means the rearward most edge of the pertinent structure. For example, the front edge of the table top 40 is the forward most edge of the table top, farthest to the right as shown in FIG. 2. The rear edge of the table top 40 is the rearward most edge of the table top, farthest to the left as shown in FIG. 2.

It will be apparent that modifications and variations are possible without departing from the scope of the invention defined in the appended claims. For example, components can have other configurations or be omitted without departing from the scope of the present invention.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A portable shooting bench for supporting a shooter above a ground surface for shooting, the shooting bench comprising:

a chair including a seat and at least one leg configured to engage the ground surface to support the seat above the ground surface, the seat having a sitting area sized and shaped to be sat on by the shooter;

a table including a table top and at least one leg, the table top including a forward section and a rearward section, the at least one leg configured to engage the ground surface to support the forward section of the table top above the ground surface;

a support structure connecting the chair to the table, the support structure configured to support the rearward section of the table top above the ground surface, the support structure defining a first pivot axis about which the table is pivotable laterally with respect to the chair to change an orientation of the chair with respect to the table.

2. The portable shooting bench of claim 1, wherein the support structure includes a linkage having an upper portion connected to the table and having a lower portion connected to the chair.

3. The portable shooting bench of claim 2, wherein the table top includes a bottom surface and the linkage extends in front of the chair and is connected to the bottom surface of the table top at the rearward section of the table top.

4. The portable shooting bench of claim 3, wherein the at least one leg of the table is connected to the bottom surface of the table top at the forward section of the table top in front of the linkage.

5. The portable shooting bench of claim 4, wherein the at least one leg of the table is connected to the table top by a leg pivot connection about which the at least one leg is pivotable between a stowed position in which the leg extends along the bottom surface of the table top and a deployed position in which the leg extends downward from the bottom surface of the table top to engage the ground surface.

6. The portable shooting bench of claim 2, wherein the linkage comprises a post having an upper post section and a lower post section, the upper post section being pivotable with respect to the lower post section about the first pivot axis to permit the chair to pivot laterally with respect to the table.

7. The portable shooting bench of claim 6, wherein the upper post section is axially pivotable with respect to the lower post section about the first pivot axis.

8. The portable shooting bench of claim 7, wherein the upper post section is pivotally connected to the table and the lower post section is pivotally connected to the chair.

9. The portable shooting bench of claim 2, wherein the support structure defines a roll axis about which the chair is configured to pivot in a generally roll direction with respect to the table.

10. The portable shooting bench of claim 9, wherein the upper portion of the linkage is pivotally connected to the table and the lower portion of the linkage is pivotally connected to the chair.

11. The portable shooting bench of claim 1, wherein the support structure defines a second pivot axis about which the chair is pivotable vertically with respect to the table.

12. The portable shooting bench of claim 11, wherein the support structure includes a pivot lock associated with the second pivot axis, the pivot lock configured to selectively prevent pivoting of the chair with respect to the table about the second pivot axis.

13. The portable shooting bench of claim 12, wherein the pivot lock includes an arcuate guide along which a component of the pivot lock is movable.

14. The portable shooting bench of claim 11, wherein the support structure includes a post having an upper portion pivotally connected to the table and having a lower portion pivotally connected to the chair.

15. The portable shooting bench of claim 1, wherein the table is not configured to fully support itself on the ground surface free of support provided by the chair via the support structure.

16. The portable shooting bench of claim 1, wherein the chair is configured to fully support itself on the ground surface free of support provided by the table via the support structure.

17. The portable shooting bench of claim 1, wherein the shooting bench is configurable in a deployed configuration and a stowed configuration, the shooting bench being configurable in the stowed configuration from the deployed configuration while maintaining the support structure connected to the chair and table, and wherein in the stowed configuration the at least one leg of the table is generally parallel with the seat and the table top, and the at least one leg of the table is generally parallel with the table top and the seat.

18. A portable shooting bench for supporting a shooter above a ground surface for shooting a firearm, the shooting bench comprising:

a seat having a sitting area sized and shaped to be sat on by the shooter, the sitting area having a front edge, a rear edge, and a length extending therebetween;

a table including a table top and at least two legs, the table top having a front edge and a rear edge and a length extending therebetween, the at least two legs configured to engage the ground surface to support the table top above the ground surface, each leg having a length extending from a proximal end of the leg to a distal end of the leg;

a linkage connecting the seat and the table;

wherein the portable shooting bench is configurable in a deployed configuration for supporting the shooter for shooting the firearm and a stowed configuration for transport and storage, the portable shooting bench being convertible from the deployed configuration to the stowed configuration while the linkage remains connected to the seat and the table;

wherein in the deployed configuration the at least two table legs extend distally downward away from the table top for engaging the ground surface to support the table top above the ground surface and the seat is positioned for being sat on by the shooter adjacent the rear end of the table top; and wherein in the stowed configuration the seat and table are collapsed together, the seat extending generally parallel to the table top, the at least two legs of the table extending generally parallel to the table top, and no leg of the table extending outboard of the front edge or the rear edge of the table top more than 40 percent of the length of the leg.

19. The portable shooting bench of claim 18, wherein in the stowed configuration at least 50 percent of the length of the sitting area is between the front and rear edges of the table top.

20. The portable shooting bench of claim 18, wherein in the stowed configuration the shooting bench has an overall length codirectional with the length of the table top, and the overall length of the shooting bench in the stowed configuration is no greater than 150 percent of the length of the table top.

21. The portable shooting bench of claim 18, wherein in the stowed configuration no leg of the table extends outboard of the front edge or the rear edge of the table top more than 25 percent of the length of the leg, and at least 75 percent of the length of the sitting area is between the front and rear edges of the table top.

22. The portable shooting bench of claim 18, wherein the linkage defines a roll axis about which the seat is configured to pivot in a roll direction with respect to the table, the seat having a deployed position with respect to the table in the deployed configuration of the shooting bench, the seat having a stowed position with respect to the table in the stowed configuration of the shooting bench, the seat being in a first pivoted orientation about the roll axis with respect to the linkage in the deployed position, and the seat being in a second pivoted orientation about the roll axis with respect to the linkage in the stowed position, the first and second pivoted orientations about the roll axis being different.

23. The portable shooting bench of claim 18, wherein in the stowed configuration the sitting area of the seat is closer to the rear edge of the table top than to the front edge of the table top.

24. A portable shooting bench for supporting a shooter above a ground surface for shooting a firearm, the shooting bench comprising:

a seat having a sitting area sized and shaped to be sat on by the shooter, the sitting area having a front edge and a rear edge and a length extending therebetween;

a table including a table top and at least two legs, the table top having a periphery including a front edge and a rear edge, the table top having a length extending between the front and rear edges, the at least two legs configured to engage the ground surface to support the table top above the ground surface, each leg having a length extending from a proximal end of the leg to a distal end of the leg;

a linkage connecting the seat and table;

wherein the portable shooting bench is configurable in a deployed configuration for supporting the shooter for shooting the firearm and a stowed configuration for transport and storage, the portable shooting bench being convertible from the deployed configuration to the stowed configuration while the linkage remains connected to the seat and the table;

wherein in the deployed configuration the linkage connects the seat and the table, the at least two table legs extend distally downward away from the table top for engaging the ground surface to support the table top above the ground surface, and the seat is positioned for being sat on by the shooter adjacent the rear end of the table top; and wherein in the stowed configuration the linkage connects the seat and the table, the seat and table being collapsed together, the seat extending generally parallel to the table top, the at least two legs of the table extending generally parallel to the table top, at least part of the sitting area being inboard of the periphery of the table top, and the front edge of the sitting area being rearward from the front edge of the table top.

25. The portable shooting bench of claim 24, wherein the linkage defines a roll axis about which the seat is configured to pivot in a roll direction with respect to the table, the seat having a deployed position with respect to the table in the deployed configuration of the shooting bench, the seat having a stowed position with respect to the table in the stowed configuration of the shooting bench, the seat being in a first pivoted orientation about the roll axis with respect to the linkage in the deployed position, and the seat being in a second pivoted orientation about the roll axis with respect to the linkage in the stowed position, the first and second pivoted orientations about the roll axis being different.

26. The portable shooting bench of claim 24, wherein in the stowed configuration the sitting area of the seat is closer to the rear edge of the table top than to the front edge of the table top.

* * * * *